US008853601B2

(12) United States Patent
Noyelle et al.

(10) Patent No.: US 8,853,601 B2
(45) Date of Patent: Oct. 7, 2014

(54) MICROWAVABLE CONSTRUCT FOR HEATING, BROWNING, AND CRISPING ROUNDED FOOD ITEMS

(75) Inventors: Marie-Line Noyelle, Romeries (FR); Arnaud Talpaert, Cambrai (FR)

(73) Assignee: Graphic Packaging International, Inc., Atlanta, GA (US)

( * ) Notice: Subject to any disclaimer, the term of this patent is extended or adjusted under 35 U.S.C. 154(b) by 520 days.

(21) Appl. No.: 13/186,728

(22) Filed: Jul. 20, 2011

(65) Prior Publication Data

US 2012/0000905 A1 Jan. 5, 2012

Related U.S. Application Data

(63) Continuation-in-part of application No. 11/712,294, filed on Feb. 28, 2007, now Pat. No. 8,008,609.

(30) Foreign Application Priority Data

Mar. 31, 2006 (EP) ..... 06290541

(51) Int. Cl.
*H05B 6/80* (2006.01)
*B65D 5/50* (2006.01)
*B65D 81/34* (2006.01)

(52) U.S. Cl.
CPC ..... *B65D 5/5038* (2013.01); *B65D 2581/3472* (2013.01); *B65D 2581/3455* (2013.01); *B65D 2581/3498* (2013.01); *B65D 81/3453* (2013.01); *B65D 2581/3444* (2013.01); *B65D 2581/3495* (2013.01); *B65D 2581/3412* (2013.01); *B65D 81/3446* (2013.01)
USPC ..... 219/731; 219/745

(58) Field of Classification Search
CPC ..... A23L 1/0128; A23L 3/01; A47J 36/027; B65D 3/266; B65D 5/701; B65D 5/2033; B65D 75/28; B65D 81/343; B65D 81/3446; B65D 81/3453; B65D 81/3461; B65D 2581/341; B65D 2581/3402; B65D 2581/3416; B65D 2581/3494; B65D 2581/3498; B65D 2585/363; B65D 2885/366; H05B 6/6408
USPC ..... 99/646 C; 219/725, 730, 732, 733, 734; 229/902, 903, 906; 426/107, 113, 122, 426/124, 234, 243
See application file for complete search history.

(56) References Cited

U.S. PATENT DOCUMENTS 4,260,060 A 4/1981 Faller
4,267,420 A 5/1981 Brastad
(Continued)

FOREIGN PATENT DOCUMENTS

EP 0 563 999 A2 10/1993
EP 0 656 301 A1 6/1995
(Continued)

OTHER PUBLICATIONS

Notification of Reason for Refusal, for JP 2009-502840 dated Jul. 4, 2011.
(Continued)

*Primary Examiner* — Tu B Hoang
*Assistant Examiner* — Brandon Harvey
(74) *Attorney, Agent, or Firm* — Womble Carlyle Sandridge & Rice, LLP

(57) ABSTRACT

A microwave energy interactive construct for heating a food item having a surface intended to be browned and/or crisped includes a flanged receiving element shaped to receive the food item. The flanged receiving element includes a plurality of hingeable flange segments, so that microwave energy interactive material disposed on the hingeable flange segments may be brought into intimate and/or proximate contact with the surface of the food item.

25 Claims, 24 Drawing Sheets

(56) References Cited

U.S. PATENT DOCUMENTS

| | | | | |
|---|---|---|---|---|
| 4,268,738 | A | 5/1981 | Flautt, Jr. et al. | |
| 4,279,933 | A | 7/1981 | Austin et al. | |
| 4,286,136 | A | 8/1981 | Mason, Jr. | |
| 4,567,341 | A | 1/1986 | Brown | |
| 4,626,641 | A | 12/1986 | Brown | |
| 4,678,882 | A | 7/1987 | Bohrer et al. | |
| 4,742,203 | A | 5/1988 | Brown et al. | |
| 4,745,249 | A | 5/1988 | Daniels | |
| 4,775,771 | A | 10/1988 | Pawlowski et al. | |
| 4,810,844 | A | 3/1989 | Anderson | |
| 4,835,352 | A | 5/1989 | Sasaki et al. | |
| 4,865,921 | A | 9/1989 | Hollenberg et al. | |
| 4,883,936 | A | 11/1989 | Maynard et al. | |
| 4,888,459 | A | 12/1989 | Keefer | |
| 4,890,439 | A | 1/1990 | Smart | |
| 4,891,482 | A | 1/1990 | Jaeger et al. | |
| 4,894,247 | A | 1/1990 | Fong | |
| 4,894,503 | A | 1/1990 | Wendt | |
| 4,896,009 | A | 1/1990 | Pawlowski | |
| 4,916,280 | A | 4/1990 | Havette | |
| 4,927,991 | A | 5/1990 | Wendt et al. | |
| 4,933,193 | A | 6/1990 | Fisher | |
| 4,936,935 | A | 6/1990 | Beckett | |
| 4,940,867 | A | 7/1990 | Peleg | |
| 4,962,293 | A | 10/1990 | Lackey | |
| 4,963,424 | A | 10/1990 | Beckett | |
| 4,968,865 | A | 11/1990 | Seaborne et al. | |
| 5,008,507 | A | 4/1991 | Pesheck et al. | |
| 5,034,234 | A | 7/1991 | Andreas | |
| 5,039,364 | A | 8/1991 | Beckett et al. | |
| 5,041,325 | A | 8/1991 | Larson et al. | |
| 5,053,594 | A | 10/1991 | Thota et al. | |
| 5,081,330 | A | 1/1992 | Brandberg et al. | |
| 5,084,601 | A | 1/1992 | Andreas | |
| 5,096,723 | A | 3/1992 | Turpin | |
| 5,117,078 | A | 5/1992 | Beckett | |
| 5,140,119 | A | 8/1992 | Brown et al. | |
| 5,164,562 | A | 11/1992 | Huffman et al. | |
| 5,177,332 | A | 1/1993 | Fong | |
| 5,213,902 | A | 5/1993 | Beckett | |
| 5,217,768 | A | 6/1993 | Walters et al. | |
| 5,221,419 | A | 6/1993 | Beckett | |
| 5,231,268 | A | 7/1993 | Hall et al. | |
| 5,239,153 | A | 8/1993 | Beckett | |
| 5,247,149 | A * | 9/1993 | Peleg | 219/729 |
| 5,256,846 | A | 10/1993 | Walters | |
| 5,260,070 | A | 11/1993 | Peleg | |
| 5,260,537 | A | 11/1993 | Beckett | |
| 5,266,386 | A | 11/1993 | Beckett | |
| 5,294,763 | A | 3/1994 | Chamberlain et al. | |
| RE34,683 | E | 8/1994 | Maynard et al. | |
| 5,334,820 | A | 8/1994 | Risch et al. | |
| 5,340,436 | A | 8/1994 | Beckett | |
| 5,354,973 | A | 10/1994 | Beckett | |
| 5,389,767 | A | 2/1995 | Dobry | |
| 5,405,663 | A | 4/1995 | Archibald et al. | |
| 5,410,135 | A | 4/1995 | Pollart et al. | |
| 5,412,187 | A | 5/1995 | Walters et al. | |
| 5,424,517 | A | 6/1995 | Habeger et al. | |
| 5,484,984 | A | 1/1996 | Gics | |
| 5,510,132 | A | 4/1996 | Gallo, Jr. | |
| 5,519,195 | A | 5/1996 | Keefer et al. | |
| 5,543,606 | A | 8/1996 | Gics | |
| 5,565,125 | A | 10/1996 | Parks | |
| 5,585,027 | A | 12/1996 | Young | |
| 5,628,921 | A | 5/1997 | Beckett | |
| 5,672,407 | A | 9/1997 | Beckett | |
| 5,688,427 | A | 11/1997 | Gallo, Jr. | |
| 5,698,127 | A | 12/1997 | Lai et al. | |
| 5,759,422 | A | 6/1998 | Schmelzer et al. | |
| 5,770,840 | A | 6/1998 | Lorence | |
| 5,800,724 | A | 9/1998 | Habeger et al. | |
| 5,864,123 | A | 1/1999 | Keefer | |
| 5,900,264 | A | 5/1999 | Gics | |
| 5,910,268 | A | 6/1999 | Keefer | |
| 5,948,308 | A | 9/1999 | Wischusen, III | |
| 6,054,698 | A | 4/2000 | Mast | |
| 6,114,679 | A | 9/2000 | Lai et al. | |
| 6,133,560 | A | 10/2000 | Zeng et al. | |
| 6,137,099 | A | 10/2000 | Hamblin | |
| 6,150,646 | A | 11/2000 | Lai et al. | |
| 6,158,589 | A * | 12/2000 | Smith et al. | 206/466 |
| 6,168,812 | B1 | 1/2001 | Paulucci | |
| 6,204,492 | B1 | 3/2001 | Zeng et al. | |
| 6,251,451 | B1 | 6/2001 | Zeng | |
| 6,359,272 | B1 | 3/2002 | Sadek et al. | |
| 6,414,290 | B1 | 7/2002 | Cole et al. | |
| 6,433,322 | B2 | 8/2002 | Zeng et al. | |
| 6,455,827 | B2 | 9/2002 | Zeng | |
| 6,501,059 | B1 | 12/2002 | Mast | |
| 6,534,755 | B1 | 3/2003 | Paulucci | |
| 6,552,315 | B2 | 4/2003 | Zeng et al. | |
| 6,559,430 | B2 | 5/2003 | Monforton et al. | |
| 6,677,563 | B2 | 1/2004 | Lai | |
| 6,717,121 | B2 | 4/2004 | Zeng et al. | |
| 6,765,182 | B2 | 7/2004 | Cole et al. | |
| 7,019,271 | B2 * | 3/2006 | Wnek et al. | 219/730 |
| 7,514,659 | B2 | 4/2009 | Lafferty | |
| 8,008,609 | B2 | 8/2011 | Noyelle et al. | |
| 8,071,924 | B2 | 12/2011 | Lafferty | |
| 8,183,506 | B2 | 5/2012 | Fitzwater | |
| 8,395,100 | B2 | 3/2013 | Laubhan | |
| 2001/0017297 | A1 | 8/2001 | Zeng et al. | |
| 2001/0021405 | A1 | 9/2001 | Zeng | |
| 2002/0144996 | A1 | 10/2002 | Zeng et al. | |
| 2003/0010777 | A1 | 1/2003 | Milgrom | |
| 2003/0085224 | A1 | 5/2003 | Tsontzidis et al. | |
| 2003/0111463 | A1 | 6/2003 | Lai | |
| 2003/0116562 | A1 * | 6/2003 | Halimi et al. | 219/730 |
| 2003/0206997 | A1 | 11/2003 | Winkelman et al. | |
| 2004/0149746 | A1 | 8/2004 | Hoese et al. | |
| 2004/0173607 | A1 | 9/2004 | Blankenbeckler et al. | |
| 2004/0232213 | A1 | 11/2004 | Pope | |
| 2005/0042360 | A1 | 2/2005 | Tiffany et al. | |
| 2005/0205565 | A1 * | 9/2005 | Cole et al. | 219/730 |
| 2006/0049190 | A1 | 3/2006 | Middleton | |
| 2006/0113300 | A1 | 6/2006 | Wnek | |
| 2006/0157480 | A1 | 7/2006 | Lafferty | |
| 2006/0289521 | A1 | 12/2006 | Bohme et al. | |
| 2007/0039951 | A1 | 2/2007 | Cole | |
| 2007/0056962 | A1 * | 3/2007 | Hopkins et al. | 219/730 |
| 2007/0087090 | A1 | 4/2007 | Russell et al. | |
| 2007/0228036 | A1 | 10/2007 | Noyelle et al. | |
| 2007/0251943 | A1 | 11/2007 | Wnek et al. | |
| 2008/0023469 | A1 | 1/2008 | Fitzwater | |
| 2009/0120929 | A1 | 5/2009 | Lafferty | |
| 2010/0038359 | A1 | 2/2010 | Laubhan | |
| 2012/0100265 | A1 | 4/2012 | Lafferty | |
| 2012/0187114 | A1 | 7/2012 | Fitzwater | |

FOREIGN PATENT DOCUMENTS

| | | | |
|---|---|---|---|
| EP | 0 970 895 | A1 | 1/2000 |
| EP | 1 840 047 | A1 | 10/2007 |
| FR | 2 828 394 | A1 | 2/2003 |
| GB | 2 368 507 | A | 5/2002 |
| JP | 62-191682 | | 12/1987 |
| JP | 63-16600 | | 1/1988 |
| JP | 64-20331 | | 2/1989 |
| JP | 1-97107 | | 6/1989 |
| JP | 09-132279 | | 5/1997 |
| JP | 09-185991 | | 7/1997 |
| WO | WO 92/00899 | A1 | 1/1992 |
| WO | WO 97/11010 | A1 | 3/1997 |
| WO | WO 89/04585 | A1 | 5/1998 |
| WO | WO 03/066435 | A2 | 8/2003 |
| WO | WO 2005/085091 | A2 | 9/2005 |
| WO | WO 2006/076501 | A1 | 7/2006 |
| WO | WO 2006/130789 | A1 | 12/2006 |
| WO | WO 2007/123611 | A1 | 11/2007 |
| WO | WO 2008/014377 | A2 | 1/2008 |
| WO | WO 2008/052096 | A1 | 5/2008 |
| WO | WO 2008/115272 | A2 | 9/2008 |
| WO | WO 2010/019758 | A2 | 2/2010 |

(56) References Cited

FOREIGN PATENT DOCUMENTS

OTHER PUBLICATIONS

International Preliminary Report on Patentability—PCT/US2006/001100, Apr. 27, 2007, Graphic Packaging International, Inc.

International Preliminary Report on Patentability—PCT/US2007/074427, Jan. 27, 2009, Graphic Packaging International, Inc.

International Preliminary Report on Patentability—PCT/US2007/006703, Sep. 30, 2008, Graphic Packaging International, Inc.

International Preliminary Report on Patentability—PCT/US2009/053675, Feb. 15, 2011, Graphic Packaging International, Inc.

Notice of Allowance and Fee(s) Due dated Nov. 9, 2012 for U.S. Appl. No. 12/583,079.

International Search Report—PCT/US2006/001100, Jan. 13, 2006, Graphic Packaging International, Inc.

Written Opinion—PCT/US2006/001100, Jan. 13, 2006, Graphic Packaging International, Inc.

International Search Report—PCT/US2007/006703, Mar. 16, 2006, Graphic Packaging International, Inc.

Written Opinion—PCT/US2007/006703, Mar. 16, 2006, Graphic Packaging International, Inc.

International Search Report—PCT/US2007/074427, Jul. 26, 2007, Graphic International, Inc.

Written Opinion—PCT/US2007/074427, Jul. 26, 2007, Graphic Packaging International, Inc.

International Search Report—PCT/US2009/053675, Aug. 13, 2009, Graphic Packaging International, Inc.

Written Opinion—PCT/US2009/053675, Aug. 13, 2009, Graphic Packaging International, Inc.

* cited by examiner

MICROWAVABLE CONSTRUCT FOR HEATING, BROWNING, AND CRISPING ROUNDED FOOD ITEMS

CROSS-REFERENCE TO RELATED APPLICATIONS

This application is a continuation-in-part of U.S. patent application Ser. No. 11/712,294, filed Feb. 28, 2007, now U.S. Pat. No. 8,008,609, which claims the benefit of European Patent Application No. 06290541.9, filed Mar. 31, 2006, both of which are incorporated by reference herein in their entirety.

TECHNICAL FIELD

This disclosure relates to various materials, packages, constructs, and systems for heating or cooking a microwavable food item. In particular, this disclosure relates to various materials, packages, constructs, and systems for heating or cooking a rounded, curved, or other shaped food item in a microwave oven.

BACKGROUND

Microwave ovens provide a convenient means for heating a variety of food items, including numerous dough-based and potato-based convenience food items. However, microwave ovens tend to cook such items unevenly and are unable to achieve the desired balance of thorough heating and a browned, crisp outer surface. Some microwave energy interactive materials and packages have been developed in an effort to achieve surface browning and crisping of food items in a microwave oven. However, there is a continuing need for improved microwave energy interactive materials and packages that provide the desired degree of heating and browning and/or crisping of various food items. There further is a continuing need for improved materials and packages that provide the desired degree of heating and browning and/or crisping of food items that have a rounded or other shape that are otherwise unable to achieve sufficient surface contact with some presently available microwave energy interactive sheet materials.

SUMMARY

The present invention is directed generally to various blanks, trays, tray assemblies, materials, constructs, packages, and systems that provide improved heating, browning, and/or crisping of a food item in a microwave oven, for example, rounded or curved food items.

In one aspect, the present invention is directed to a blank for forming a microwave energy interactive construct. The blank includes a laminate comprising microwave energy interactive material (e.g., that may be configured as a microwave energy interactive element) at least partially secured to a panel in an at least partially overlapping relationship, and at least one flanged receiving element including a plurality of flange segments. The flange segments extend at least generally inwardly and are respectively adjacent to one another. Additionally, the flange segments are at least partially defined by a plurality of disruptions that are respectively disposed between adjacent flange segments of the plurality of flange segments, extend at least partially through the microwave energy interactive element, and extend at least partially through the panel. The plurality of disruptions may comprise, for example, a plurality of slits (e.g., cuts or cutouts) arranged radially or in any other suitable configuration. The flange segments may be coplanar with the laminate or may extend obliquely with respect to a generally planar portion of the laminate. The generally planar portion of the laminate may extend at least partially around the flanged receiving element.

In one particular example, the generally planar portion of the laminate includes opposite first and second sides, the microwave energy interactive element forms the first side of the generally planar portion of the laminate, and the flange segments are capable of projecting away from, and are adjacent to, the second side of the generally planar portion of the laminate. The flange segments of the flanged receiving element may extend at least partially around and define a receptacle. When used with a food item, the food item may be disposed in the receptacle, portions of the microwave energy interactive element may be respective parts of the flanged segments of the flanged receiving element, and at least some of the portions of the microwave energy interactive element that are respective parts of the flanged segments of the flanged receiving element may be in opposing face-to-face contact with the food item.

In another aspect, the present invention is directed to a blank for forming a microwave energy interactive tray. The blank includes a base panel, microwave energy interactive material configured as a microwave energy interactive element at least partially overlying the base panel, at least one flanged receiving element including a plurality of flange segments, the flange segments being defined by a plurality of radially or outwardly arranged slits (e.g., cuts or cutouts) extending through the microwave energy interactive element and base panel, and at least one side panel joined to the base panel. If desired, the radially arranged slits may extend from a physical aperture through the microwave energy interactive element and base panel. The radially arranged slits (e.g., cuts or cutouts) may be arranged in a starburst pattern, spiral pattern, or any other pattern. Each flange segment may be defined by a pair of adjacent slits terminating at respective end points and a fold line extending therebetween.

In another aspect, the blank includes a first major panel and a second major panel joined along a major fold line. The first major panel and the second major each independently include microwave energy interactive material configured as a microwave energy interactive element and at least one flanged receiving element including a plurality of flange segments. The flange segments are defined by a plurality of radially or outwardly arranged slits (e.g., cuts or cutouts). The flanged receiving element in the first panel and the flanged receiving element in the second panel are arranged in a substantially aligned, opposed relation along a line of symmetry defined by the major fold line. The radially arranged slits may extend from a physical aperture through the microwave energy interactive element and the panel. If desired, a fold line may extend between the respective endpoints of each pair of adjacent slits defining a flange segment.

According to another aspect of the present invention, a tray assembly comprises at least one pair of substantially aligned flanged receiving elements in an opposed, facing relation in a first tray and a second tray, where each of the flanged receiving elements in the first tray and the second tray includes a plurality of flange segments defined by radially or outwardly arranged slits (e.g., cuts or cutouts) extending through the tray. A microwave energy interactive element independently overlies a substantial portion of each of the flange segments. At least one of the first tray and the second tray may comprise at least one elevating element extending therefrom. The radially arranged slits may extend in a starburst configuration from a physical aperture, or may have any other configuration.

According to another aspect of the invention, a microwave energy interactive heating system comprises a carton and a tray dimensioned to be received within the carton. The carton includes a top panel, a bottom panel, and a plurality of walls extending between the top panel and bottom panel, where the top panel, bottom panel, and walls define an interior space. Microwave energy interactive material configured as a first microwave energy interactive element overlies at least a portion of the top panel facing the interior space. The tray includes microwave energy interactive material configured as a second microwave energy interactive element at least partially overlying a dimensionally stable base, at least one support element for elevating the base from the bottom panel of the carton, and at least one flanged receiving element including a plurality of hingeable flange segments, where the hingeable flange segments are defined by a plurality of radially arranged slits (e.g., cuts or cutouts) that extend through the microwave energy interactive element and dimensionally stable base. The first microwave energy interactive element may comprise a susceptor, a microwave energy interactive insulating material, or any other suitable material. In one example, the microwave energy interactive insulating material comprises a microwave energy interactive material supported on a first polymeric film layer, a moisture-containing layer superposed with the microwave energy interactive material, and a second polymeric film layer joined to the moisture-containing layer in a predetermined pattern, thereby forming one or more closed cells between the moisture-containing layer and the second polymeric film layer. The closed cells expand in response to being exposed to microwave energy, and the expanded cells cause the microwave energy interactive material to bulge toward the microwave energy interactive tray.

According to another aspect of the present invention, a method of heating, browning, and crisping a food item in a microwave oven is provided. The method includes providing a microwave energy interactive heating tray, the tray including a dimensionally stable base having at least one elevating support element extending from a first surface thereof, microwave energy interactive material configured as a microwave energy interactive element at least partially overlying a second surface opposed to the first surface, and at least one flanged receiving element including a plurality of hinged flange segments, the flange segments being defined by a plurality of radially arranged slits (e.g., cuts or cutouts) extending through the microwave energy interactive element and dimensionally stable base, urging the food item against the flanged receiving element, thereby causing the flange segments to deflect in a direction toward the support element, lodging the food item between the deflected flange segments, such that at least a portion of the food item is in intimate contact with the microwave energy interactive element, and exposing the food item lodged within the receiving element to microwave energy.

Other aspects, features, and advantages of the present invention will become apparent from the following description and accompanying figures.

BRIEF DESCRIPTION OF THE DRAWINGS

The description refers to the accompanying drawings in which like reference characters refer to like parts throughout the several views, and in which.

DESCRIPTION

Figure 1A:
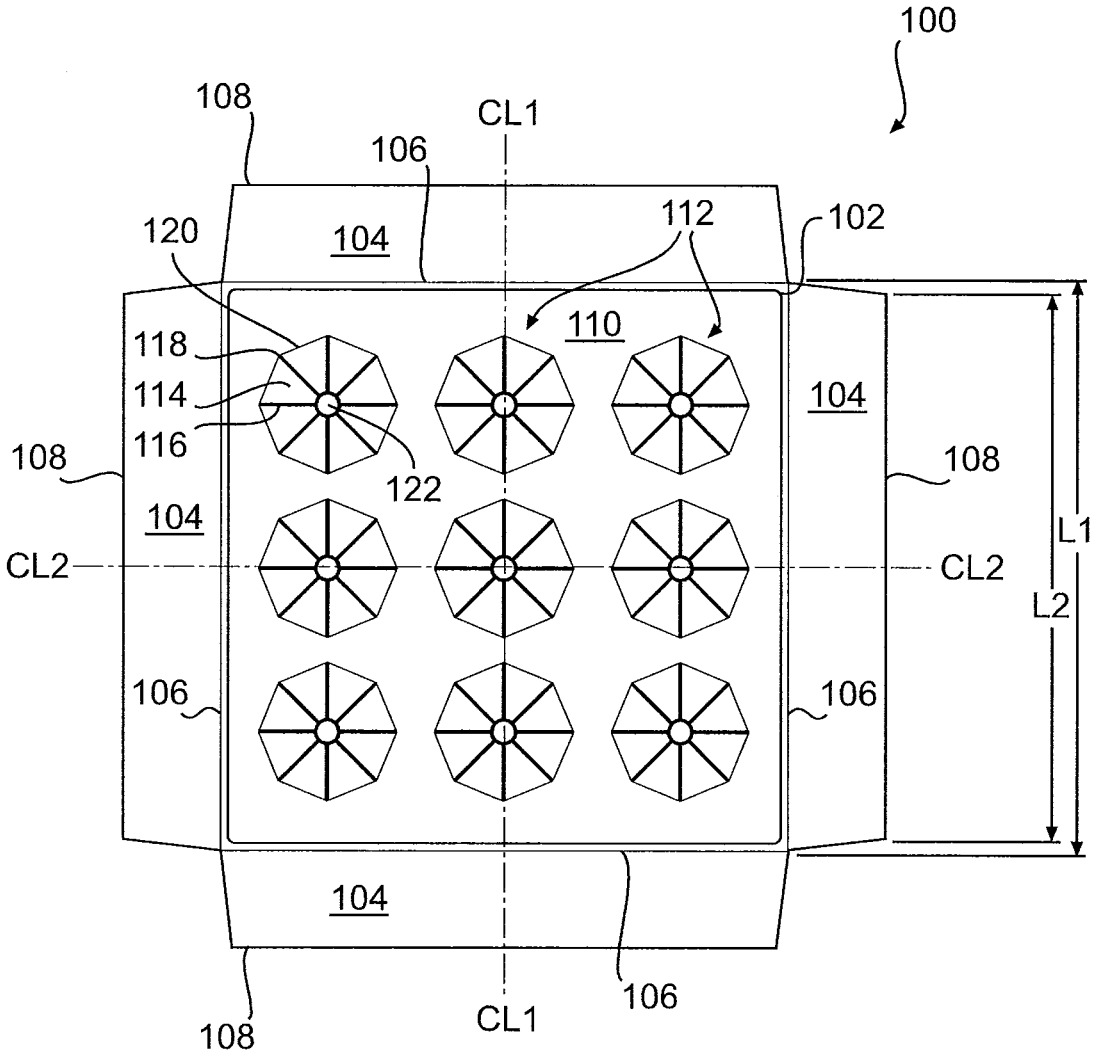
FIG. 1A depicts an exemplary blank that may be used to form a microwave energy interactive heating tray, according to various aspects of the present invention.

The present invention is directed generally to various blanks for forming a microwave energy interactive tray, package, system, or other construct (collectively "constructs"), various constructs formed therefrom, various methods of making such constructs, and various methods of heating and browning and/or crisping a food item having a rounded surface.

The various constructs may include one or more features that accommodate the contours of a rounded or curved food item contained within the package. For example, the various constructs may include one or more receiving elements that are divided into a plurality of smaller segments, where segment is operative of flexing to accommodate the contours of the food item. The various constructs also may include one or more features that enhance microwave heating, browning, and/or crisping of the food item. Such features may overlie and/or be joined to at least a portion of the flexible segments, such that the contours of the food item are in proximate or intimate contact with the microwave enhancing feature.

In one aspect, the present invention is directed to a microwave energy interactive heating construct, for example, a tray, including a base or platform for supporting a food item thereon and one or more support elements for elevating the base or platform from the floor of a microwave oven. In another aspect, the tray includes one or more contoured, flanged receiving elements, each for supporting a rounded or curved food item. In still another aspect, the tray includes one or more apertures in communication with the contoured receiving elements for allowing any oils, grease, or other liquids to drain from the food items therein. In a further aspect, the base or platform is at least partially covered by microwave energy interactive material configured as a microwave energy interactive element for enhancing the browning and/or crisping of the food item.

If desired, the tray may be positioned within a carton. The carton may include a bottom panel and a lid, the tray being supported on the bottom panel. In one aspect, the inner surface of the lid also is contoured to accommodate the shape of the rounded or curved food item. The inner surface also may be at least partially covered by microwave energy interactive material configured as a microwave energy interactive element for enhancing the browning and/or crisping of the food item. In another aspect, a flexible, expandable microwave energy interactive insulating material overlies at least a portion of the inner surface of the lid. Upon exposure to microwave energy, the material expands towards, and accommodates the contours of, the food item to enhance the browning and/or crisping thereof.

Various aspects of the invention may be illustrated by referring to the figures. For purposes of simplicity, like numerals may be used to describe like features. It will be understood that where a plurality of similar features are depicted, not all of such features necessarily are labeled on each figure. Although several different exemplary aspects, implementations, and embodiments of the various inventions are provided, numerous interrelationships between, combinations thereof, and modifications of the various inventions, aspects, implementations, and embodiments of the inventions are contemplated hereby.

FIG. 1A depicts an exemplary blank 100 that may be used according to various aspects of the present invention. The blank 100 includes a base panel 102 and a plurality of side panels 104 extending from the base panel 102 along respective fold lines 106. In this example, the base panel 102 is substantially square in shape and substantially symmetrical along lines of symmetry CL1 and CL2. However, it will be understood that the base panel may be any suitable shape, for example, circular, triangular, rectangular, pentagonal, hexagonal, octagonal, or any other regular shape or irregular shape as needed or desired. Each of the side panels 104 is somewhat trapezoidal in shape, with a first dimension, L1, defined by the length of the respective fold lines 106, and a second dimension, L2, defined by the length of respective edges 108.

In the exemplary blank 100 shown in FIG. 1A, a microwave energy interactive element 110 at least partially overlies and may be joined to at least a portion of the base panel 102 in an overlapping relationship. For example, the microwave energy interactive element 110 may comprise a susceptor (i.e., a thin layer of a microwave energy interactive material), which may be supported on a microwave transparent or "inactive" substrate, e.g., a polymer film, to define a "susceptor film". When sufficiently exposed to microwave energy, the microwave energy interactive material tends to absorb microwave energy, thereby generating heat and promoting browning and/or crisping of the surface of the food item. While susceptors are described in detail herein, it will be understood that microwave energy interactive material configured as other microwave energy interactive elements may be used in accordance with the present invention. For example, the microwave energy interactive element may comprise a microwave energy shielding element or a microwave energy directing element.

In some embodiments, the microwave energy interactive material may comprise an electroconductive or semiconductive material, for example, a metal or a metal alloy provided as a metal foil; a vacuum deposited metal or metal alloy; or a metallic ink, an organic ink, an inorganic ink, a metallic paste, an organic paste, an inorganic paste, or any combination thereof. Examples of metals and metal alloys that may be suitable include, but are not limited to, aluminum, chromium, copper, inconel alloys (nickel-chromium-molybdenum alloy with niobium), iron, magnesium, nickel, stainless steel, tin, titanium, tungsten, and any combination or alloy thereof.

Alternatively, the microwave energy interactive material may comprise a metal oxide. Examples of metal oxides that may be suitable include, but are not limited to, oxides of aluminum, iron, and tin, used in conjunction with an electrically conductive material where needed. Another example of a metal oxide that may be suitable is indium tin oxide (ITO). ITO can be used as a microwave energy interactive material to provide a heating effect, a shielding effect, a browning and/or crisping effect, or a combination thereof. For example, to form a susceptor, ITO may be sputtered onto a clear polymeric film. The sputtering process typically occurs at a lower temperature than the evaporative deposition process used for metal deposition. ITO has a more uniform crystal structure and, therefore, is clear at most coating thicknesses. Additionally, ITO can be used for either heating or field management effects. ITO also may have fewer defects than metals, thereby making thick coatings of ITO more suitable for field management than thick coatings of metals, such as aluminum.

Alternatively, the microwave energy interactive material may comprise a suitable electroconductive, semiconductive, or non-conductive artificial dielectric or ferroelectric. Artificial dielectrics comprise conductive, subdivided material in a polymeric or other suitable matrix or binder, and may include flakes of an electroconductive metal, for example, aluminum.

The substrate for the microwave energy interactive material may comprise a polymeric material, paper, paperboard, or any combination thereof. As used herein the term "polymer" or "polymeric material" includes, but is not limited to, homopolymers, copolymers, such as for example, block, graft, random, and alternating copolymers, terpolymers, etc. and blends and modifications thereof. Furthermore, unless otherwise specifically limited, the term "polymer" includes all possible geometrical configurations of the molecule. These configurations include, but are not limited to isotactic, syndiotactic, and random symmetries. Examples of polymers that may be suitable for use with the present invention include, but are not limited to, polyolefins, e.g. polyethylene, polypropylene, polybutylene, and copolymers thereof; polytetrafluoroethylene; polyesters, e.g. polyethylene terephthalate, e.g., coextruded polyethylene terephthalate; vinyl polymers, e.g., polyvinyl chloride, polyvinyl alcohol, polyvinylidene chloride, polyvinyl acetate, polyvinyl chloride acetate, polyvinyl butyral; acrylic resins, e.g. polyacrylate, polymethylacrylate, and polymethylmethacrylate; polyamides, e.g., nylon 6,6; polystyrenes; polyurethanes; polycarbonates; cellulosic resins, e.g., cellulosic nitrate, cellulosic acetate, cellulosic acetate butyrate, ethyl cellulose; copolymers of any of the above materials; or any blend or combination thereof.

In one particular example, the substrate comprises an electrical insulator, for example, a polymeric film. The thickness of the film typically may be from about 35 gauge to about 10 mil. In one aspect, the thickness of the film is from about 40 to about 80 gauge. In another aspect, the thickness of the film is from about 45 to about 50 gauge. In still another aspect, the thickness of the film is about 48 gauge.

Examples of polymeric films that may be suitable include, but are not limited to, polyolefins, polyesters, polyamides, polyimides, polysulfones, polyether ketones, cellophanes, or any combination thereof. In one particular example, the polymeric film comprises polyethylene terephthalate. Examples of polyethylene terephthalate films that may be suitable for use as the substrate include, but are not limited to, MELINEX®, commercially available from DuPont Teijan Films (Hopewell, Va.), and SKYROL, commercially available from SKC, Inc. (Covington, Ga.). Polyethylene terephthalate films are used in commercially available susceptors, for example, the QWIKWAVE® Focus susceptor and the MICRORITE® susceptor, both available from Graphic Packaging International (Marietta, Ga.). While polymeric substrates are described in detail herein, it will be understood that other non-conducting substrate materials such as paper and paper laminates, metal oxides, silicates, cellulosics, or any combination thereof, also may be used.

If desired, the polymeric film may be selected to provide a water barrier, oxygen barrier, or a combination thereof. Such barrier film layers may be formed from a polymer film having barrier properties or from any other barrier layer or coating as desired. Suitable polymer films may include, but are not limited to, ethylene vinyl alcohol, barrier nylon, polyvinylidene chloride, barrier fluoropolymer, nylon 6, nylon 6,6, coextruded nylon 6/EVOH/nylon 6, silicon oxide coated film, or any combination thereof.

One example of a barrier film that may be suitable for use with the present invention is CAPRAN® EMBLEM 1200M nylon 6, commercially available from Honeywell International (Pottsville, Pa.). Another example of a barrier film that may be suitable is CAPRAN® OXYSHIELD OBS monoaxially oriented coextruded nylon 6/ethylene vinyl alcohol (EVOH)/nylon 6, also commercially available from Honeywell International. Yet another example of a barrier film that may be suitable for use with the present invention is DARTEK® N-201 nylon 6,6, commercially available from Enhance Packaging Technologies (Webster, N.Y.).

Still other barrier films include silicon oxide coated films, such as those available from Sheldahl Films (Northfield, Minn.). Thus, in one example, a susceptor may have a structure including a film, for example, polyethylene terephthalate, with a layer of silicon oxide coated onto the film, and ITO or other material deposited over the silicon oxide. If needed or desired, additional layers or coatings may be provided to shield the individual layers from damage during processing.

The barrier film may have an oxygen transmission rate (OTR) as measured using ASTM D3985 of less than about 20 $cc/m^2/day$. In one aspect, the barrier film has an OTR of less than about 10 $cc/m^2/day$. In another aspect, the barrier film has an OTR of less than about 1 $cc/m^2/day$. In still another aspect, the barrier film has an OTR of less than about 0.5 $cc/m^2/day$. In yet another aspect, the barrier film has an OTR of less than about 0.1 $cc/m^2/day$.

The barrier film may have a water vapor transmission rate (WVTR) as measuring using ASTM F1249 of less than about 100 $g/m^2/day$. In one aspect, the barrier film has a WVTR of less than about 50 $g/m^2/day$. In another aspect, the barrier film has a WVTR of less than about 15 $g/m^2/day$. In yet another aspect, the barrier film has a WVTR of less than about 1 $g/m^2/day$. In still another aspect, the barrier film has a WVTR of less than about 0.1 $g/m^2/day$. In a still further aspect, the barrier film has a WVTR of less than about 0.05 $g/m^2/day$.

The microwave energy interactive material may be applied to the substrate in any suitable manner, and in some instances, the microwave energy interactive material is printed on, extruded onto, sputtered onto, evaporated on, or laminated to the substrate.

The microwave energy interactive material may be applied to the substrate in any pattern, and using any technique, to achieve the desired heating effect of the food item. For example, the microwave energy interactive material may be provided as a continuous or discontinuous layer or coating including circles, loops, hexagons, islands, squares, rectangles, octagons, and so forth. Examples of various patterns and methods that may be suitable for use with the present invention are provided in U.S. Pat. Nos. 6,765,182; 6,717,121; 6,677,563; 6,552,315; 6,455,827; 6,433,322; 6,414,290; 6,251,451; 6,204,492; 6,150,646; 6,114,679; 5,800,724; 5,759,422; 5,672,407; 5,628,921; 5,519,195; 5,424,517; 5,410,135; 5,354,973; 5,340,436; 5,266,386; 5,260,537; 5,221,419; 5,213,902; 5,117,078; 5,039,364; 4,963,424; 4,936,935; 4,890,439; 4,775,771; 4,865,921; and Re. 34,683, each of which is incorporated by reference herein in its entirety. Although particular examples of patterns of microwave energy interactive material are shown and described herein, it should be understood that other patterns of microwave energy interactive material are contemplated by the present invention.

In the example blank 100 illustrated in FIG. 1A, the base panel 102 includes a plurality of flanged receiving elements or receptacles 112 for heating, browning, and/or crisping a food item, for example, a potato ball, fruit dumpling, egg roll, or other food item. In this example, the base panel 102 includes nine flanged receiving elements 112, each capable of receiving a food item (not shown). However, it will be understood that any number and shape of flanged receiving elements 112 may be used as desired. Thus, for example, the base panel may include 1, 2, 3, 4, 5, 6, 7, 8, 10, or any other number of flanged receiving elements, and such flanged receiving elements may have any shape. The number, size, and shape of the flanged receiving elements may depend on numerous factors including, but not limited to, the number of food items to be heated, the size of the food items, and the desired tray size. Thus, for example, the flanged receiving element may be somewhat elongate or obround in shape to receive an elongated food item, for example, an egg roll, taquito, burrito, or sandwich. (As used herein, the term "obround" refers to a shape consisting of two semicircles connected by parallel lines tangent to their endpoints.) As another example, the flanged receiving element may be somewhat square in shape to receive a somewhat cube-shaped food item, for example, a breaded cheese curd or pizza roll. In other examples, the flanged receiving element may be shaped differently, as needed to accommodate the shape of a particular food item.

Each flanged receiving element 112 includes a plurality of generally planar flange segments 114 defined by a plurality of disruptions, in this example, slits 116 (e.g., cuts or cutouts) extending through the microwave energy interactive element 110 and base panel 102. The slits 116 or other disruptions may have any shape, length, and with, and may be arranged in, for example, a starburst pattern (as shown in FIG. 1A), grid pattern, a spiral pattern, or in any other suitable pattern or configuration. Each flange segment 114 is defined by a pair of adjacent slits 116 or other disruptions that terminate at respective end points 118. The disruptions 116 may extend at least partially through the microwave energy interactive element 110 and/or at least partially through the base panel 102.

Figure 1B:
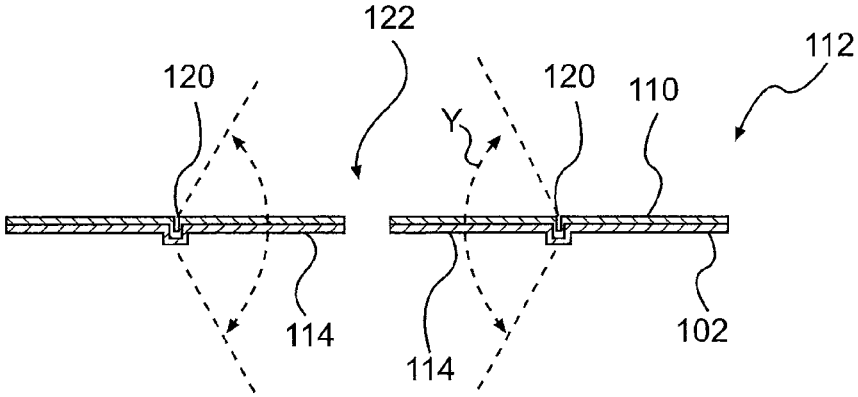
FIGS. 1B and 1C depict an exemplary receiving element according to various aspects of the present invention, in use.
Figure 1C:
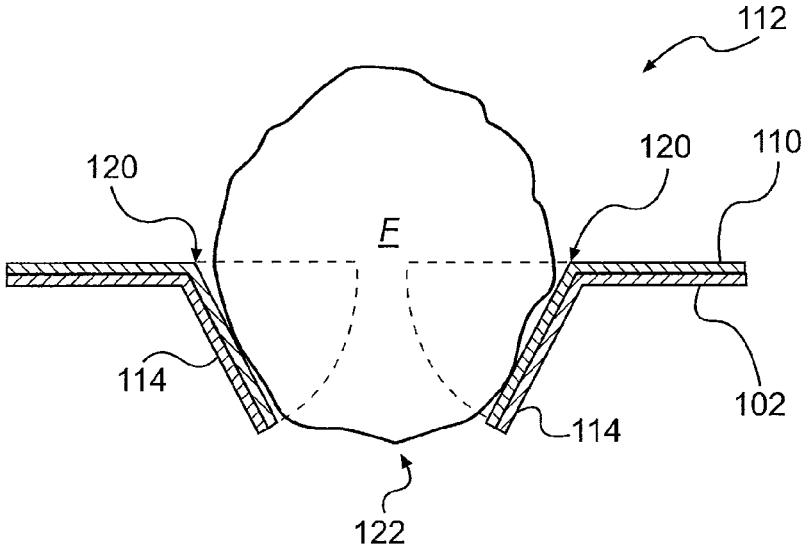
Figure 1D:
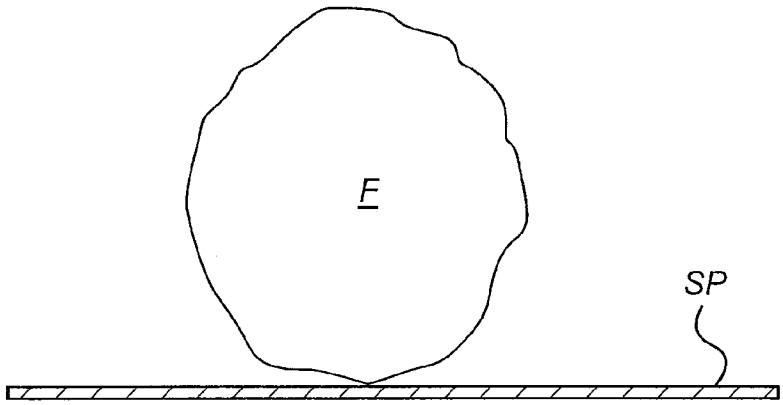
FIG. 1D (PRIOR ART)
FIG. 1D depicts a prior art susceptor.

As illustrated schematically in FIGS. 1B and 1C, the flange segments 114 are capable of being urged in a direction Y away from the plane of the base panel 102, thereby defining a space for receiving a rounded food item F therein. After being inserted, the food item F is maintained in a suspended, substantially secure position within the flanged receiving element 112, with the flange segments 114 extending obliquely from the plane of the base panel 102. As a result, a greater percentage of the surface of the food item F is brought into contact with the susceptor 110 as compared with simply positioning the food item F on a flat susceptor panel SP, as shown schematically in FIG. 1D.

Optionally, a fold line, score line, crease, cut crease line, or any other folding feature 120 (collectively "fold line") may extend between the respective end points 118 to facilitate flexing or hinging of the respective flange segment 114, as depicted in FIGS. 1A-1C.

Any of the numerous microwave interactive elements described herein or contemplated hereby may be continuous, that is, without substantial breaks or interruptions, or may be discontinuous, for example, by including one or more breaks or apertures that transmit microwave energy therethrough. For example, as illustrated in FIG. 1A, slits 116 extend outwardly or radially from a physical aperture or opening 122 through the microwave energy interactive element 110 and the base panel 102.

The breaks or apertures may be sized and positioned to heat particular areas of the food item selectively. In this example, the aperture is substantially circular in shape and is located centrally within the flanged receiving element. However, the number, shape, size, and positioning of such breaks or apertures may vary for a particular application depending on type of container being formed, the food item to be heated therein or thereon, the desired degree of shielding, browning, and/or crisping, whether direct exposure to microwave energy is needed or desired to attain uniform heating of the food item, the need for regulating the change in temperature of the food item through direct heating, and whether and to what extent there is a need for venting.

It will be understood that, in this and other aspects of the invention, the aperture may be a physical aperture or void in the microwave energy interactive element, or may be a non-physical "aperture". A non-physical aperture may be a portion of the microwave energy interactive element that is microwave energy inactive by deactivation or otherwise, or one that is otherwise transparent to microwave energy. Thus, for example, where a microwave energy interactive material is used to form at least a portion of the tray, the aperture may be a portion of the container formed without a microwave energy active material or, alternatively, may be a portion of the tray formed with a microwave energy active material that has been deactivated. While both physical and non-physical apertures allow the food item to be heated directly by the microwave energy, a physical aperture also provides a venting function to allow steam or other vapors to escape from the interior of the container.

Figure 1E:
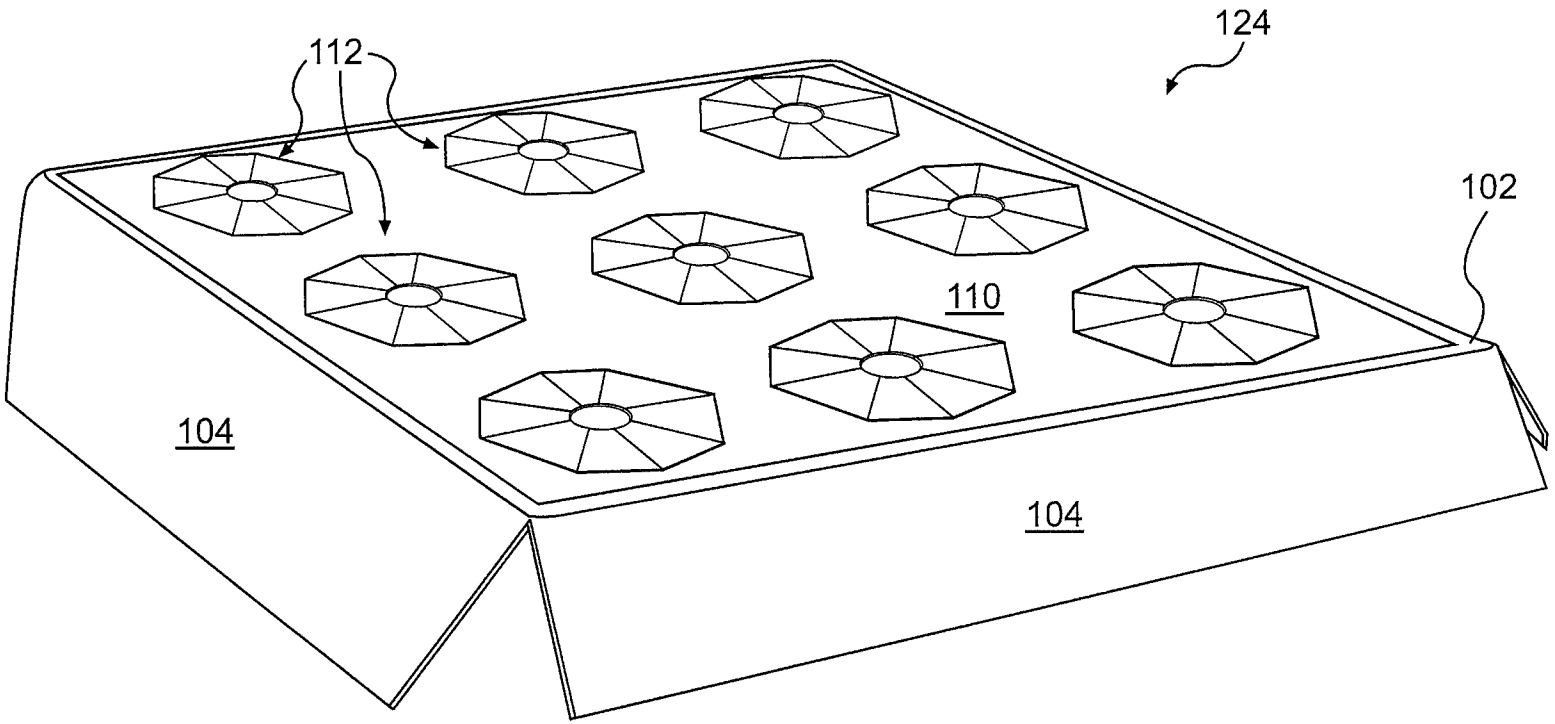
FIG. 1E depicts a microwave interactive heating tray formed from the exemplary blank of FIG. 1A.

To assemble the blank 100 into a tray 124 for heating, browning, and/or crisping a food item, the side panels 104 are folded along respective fold lines 106 in a direction away from the microwave energy interactive element 110 so that the side panels 104 are somewhat vertical with respect to the base panel 102, as shown in FIG. 1E. In this configuration, the base panel 102 serves as a platform to support a food item or a plurality of food items (not shown) thereon in contact with the microwave energy interactive element 110, and the side panels 104 serve as support elements or legs that elevate the platform or base panel 102 a distance from the floor of the microwave oven (not shown). In this and other aspects of the invention, it will be understood that although a particular sequence of steps is provided herein, the various trays, tray assemblies, cartons, and systems may be assembled in any suitable manner with a variety of different sequences of process steps.

Figure 1F:
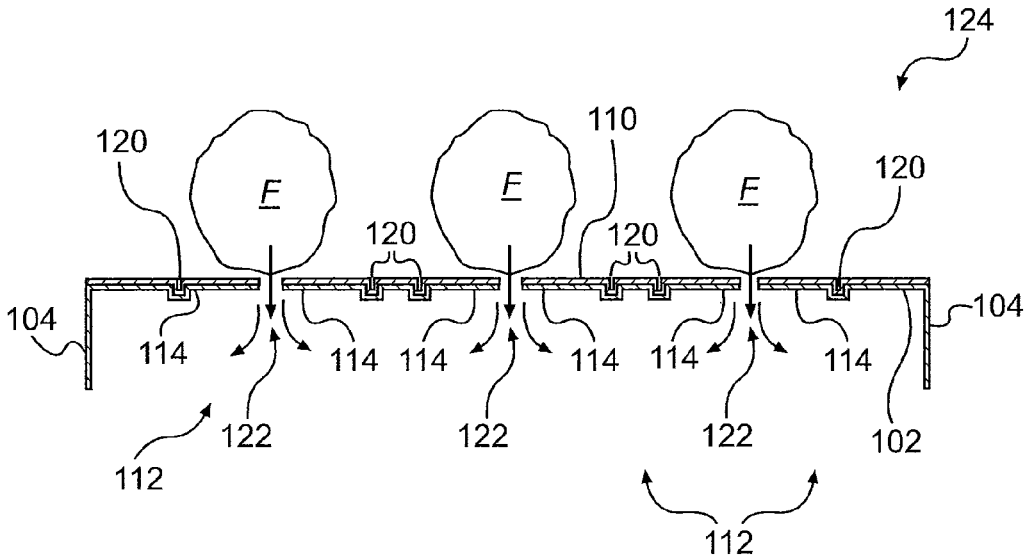
FIGS. 1F and 1G schematically depict the tray of FIG. 1A in use.
Figure 1G:
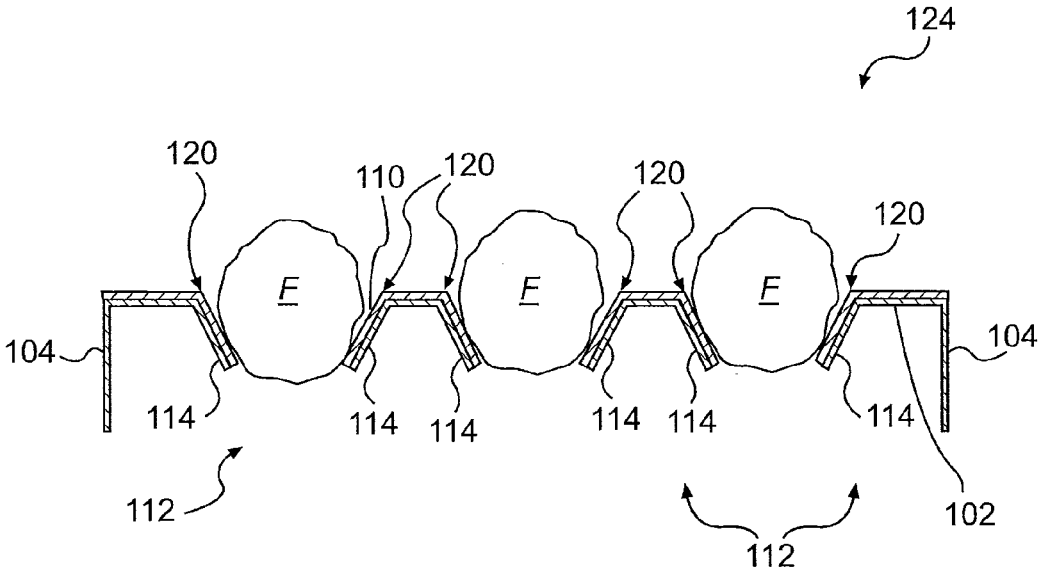

As shown in schematic side view shown in FIGS. 1F and 1G a food item F may be urged against the flange segments 114, thereby causing the flange segments 114 to flex away from the remainder of the base panel 102. As a result, the rounded food item F, which might otherwise have a tendency to roll around becomes securely lodged within the flanged receiving element 112 with at least a portion of the food item F lying below the plane of the base panel 102. In doing so, the food item F seated therein has greater contact with the susceptor material 110, and therefore greater surface area capable of being browned and/or crisped. Additionally, any grease, oils, or other fluids may drip from the food item during heating. As will be readily apparent to those of skill in the art, a plurality of such food items may be heated, browned, and/or crisped in this manner.

Figure 2A:
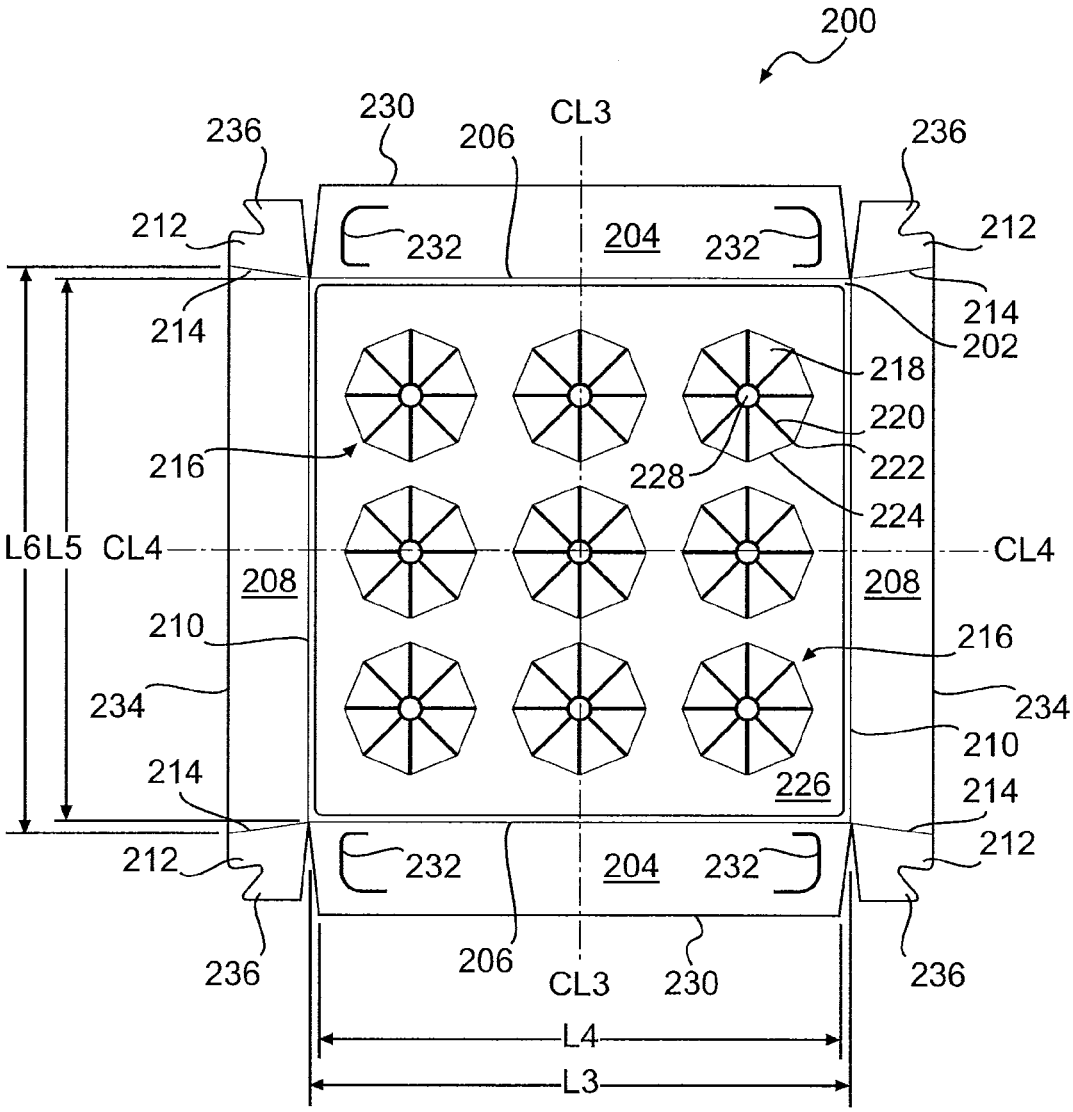
FIG. 2A depicts another exemplary blank that may be used to form a microwave energy interactive heating tray, according to various aspects of the present invention.

FIG. 2A depicts another exemplary blank 200 that may be used according to various aspects of the present invention. The blank 200 is substantially symmetrical along centerlines CL3 and CL4. The blank 200 includes a base panel 202, a pair of opposed end panels 204 joined to the base panel 202 along respective fold lines 206, and a pair of opposed side panels 208 joined to the base panel 202 along respective fold lines 210. Each side panel 208 includes a pair of corner panels 212 extending therefrom along respective fold lines 214. In this example, the base panel 202 is substantially square in shape. However, it will be understood that the base panel may have any shape, as needed or desired for a particular application.

The base 202 includes a plurality of flanged receiving elements 216, each including a plurality of flange segments 218 defined by a pair of adjacent slits 220 terminating at respective end points 222. Optionally, a fold line, score line, crease, cut crease, or any other folding feature 224 (collectively "fold line") may extend between the respective end points 222 to facilitate flexing or hinging of the respective flange segment 218 in a direction away from a microwave energy interactive element 226, for example, a susceptor, that at least partially overlies the base panel 202, similar to that shown in FIGS. 1B and 1C. In this example, each set of slits 220 extends from a substantially circular aperture 228 through the base panel 202 and the microwave energy interactive element 226.

Each end panel 204 is somewhat trapezoidal in shape, with a first dimension L3 approximately defined by the length of fold line 206 extending between fold lines 210, and a second dimension smaller L4 than the first dimension L3 that corresponds to the length of edge 230, such that the end panel 204 has a tapered width when measured from fold line 206 to respective edges 230. Each end panel 204 includes a pair of somewhat C-shaped opposed receiving slots 232.

Each side panel 208 also is somewhat trapezoidal in shape, with a first dimension L5 defined by the length of fold line 210 extending between fold lines 206, and a second dimension L6 greater than the first dimension L5 corresponding to the length of edge 234, such that the side panel 208 has a reverse tapered width when measured from fold line 210 to edge 234.

Figure 2B:
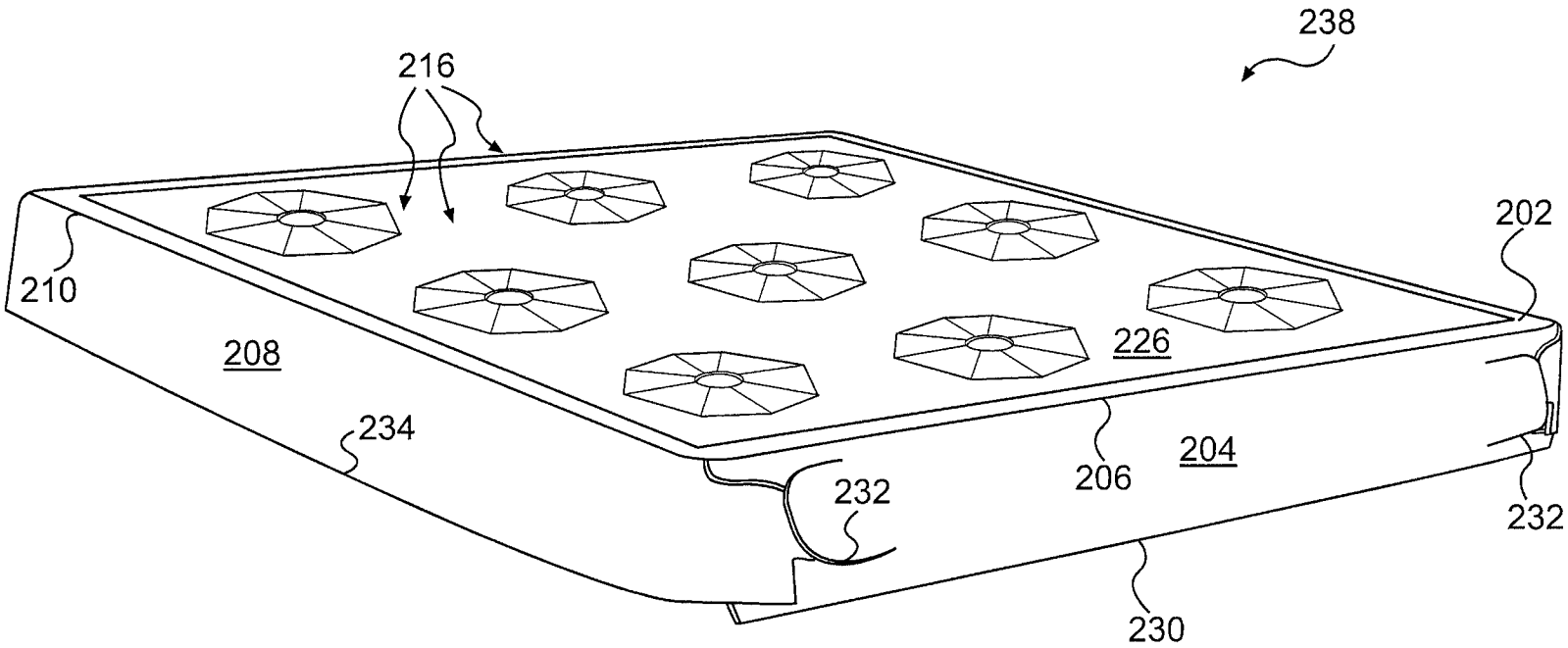
FIG. 2B depicts a microwave interactive heating tray formed from the exemplary blank of FIG. 2A, in use.

Each corner panel 212 includes a notched locking tab 236 dimensioned to fit within the adjacent receiving slot 232 in the respective side panel 208 when the blank 200 is folded into a tray 238, as shown in FIG. 2B.

To form a tray 238 from the blank 200, the end panels 204 and side panels 208 are folded in a direction away from the microwave energy interactive element 226 so that the panels 204 and 208 are substantially perpendicular to the base panel 202. The corner panels 212 are folded inwardly, and the respective locking tabs 240 each are inserted into the associated receiving slot 232, thereby securing the panels 204 and 206 in this configuration. The folded end panels 204, side panels 208, and corner panels 212 serve as support elements or legs to support the base panel 202, which serves as a platform for placing a food item (not shown) thereon, similar to that described above in connection with FIGS. 1F and 1G.

Figure 3A:
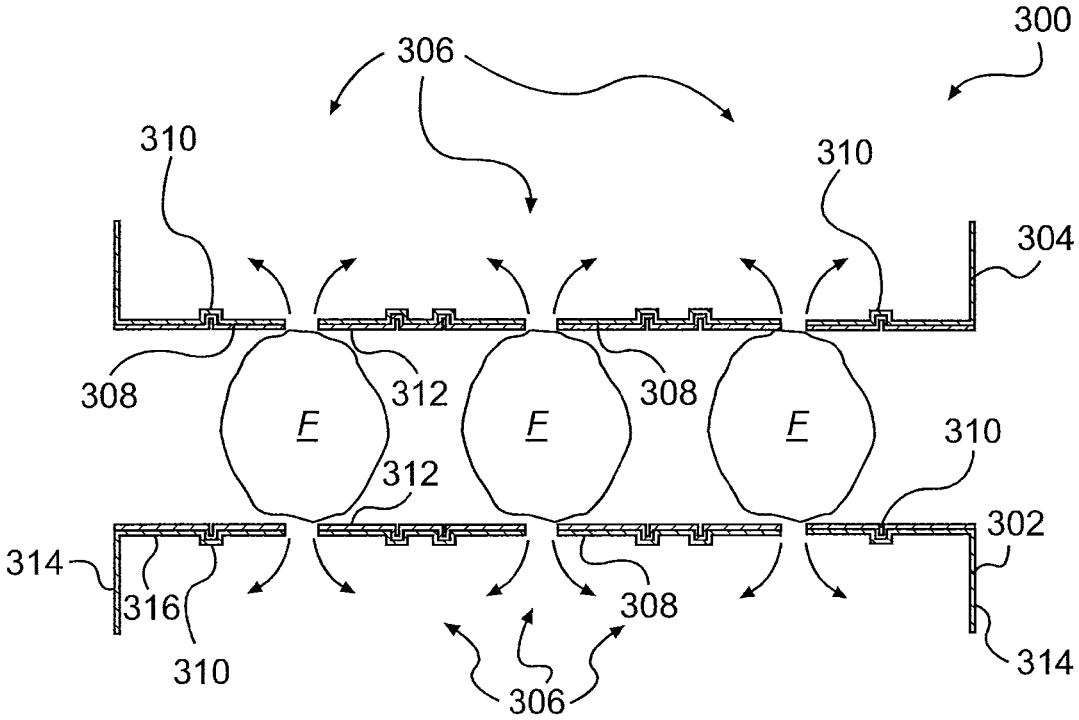
FIGS. 3A and 3B depict an exemplary tray assembly that may be used in according to various aspects of the present invention.
Figure 3B:
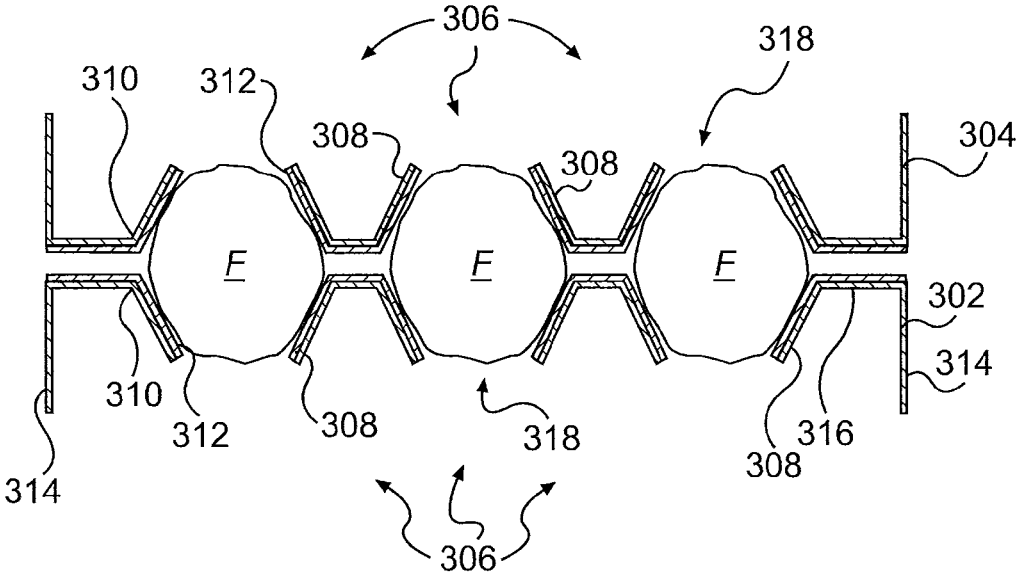

FIGS. 3A and 3B provide a schematic representation of a tray assembly 300 in accordance with various aspects of the invention. The tray assembly 300 includes a pair of trays 302, 304 arranged in an stacked, opposed relation, with at least one pair of substantially aligned flanged receiving elements 306 in an opposed, facing relation in the first tray 302 and the second tray 304. Any suitable tray may be used, including any of those described herein or contemplated hereby.

Each of the flanged receiving elements 306 in the first tray 302 and the second tray 304 includes a plurality of flange segments 308 defined by radially arranged slits (not shown) extending through each tray 302, 304, as described above. Each flange segment 308 may be defined by a pair of adjacent slits (not shown) terminating at respective end points (not shown). A fold line 310 or other feature may extend between the respective end points to facilitate hinging of the flange segment 308 in response an urging force applied thereto. A microwave energy interactive element 312 overlies a substantial portion of each flange segment 308.

At least one of the trays 302, 304 may include one or more feet, legs, or other support elements 314, for example, extending from a bottom surface 316 thereof, to elevate the tray assembly 300 from the floor of the microwave oven (not shown). Alternatively, the tray assembly 300 may be provided with a separate component, for example, a dimensionally stable ring (not shown), to elevate the tray assembly 300.

As shown in FIGS. 3A and 3B, each food item F to be heated may be urged against the flange segments 308 in the first tray 302 to cause the flange segments 308 to flex away from the food item F and create a void or cavity 318 into which the food item F can be received. The food item F is maintained in a suspended, elevated condition by the flange segments 308. In this configuration, a greater portion of the surface of the food item F is in proximate or intimate contact with the microwave energy interactive element 312, as discussed above.

The second tray 304 then can be placed over the food item F within the first tray 302. In doing so, the flange segments 308 in the second tray 304 flex away from the first tray 302 to receive the food item F therein. In this configuration, a greater portion of the surface of the food item F is in proximate or intimate contact with the microwave energy interactive element 312. Thus, the use of a dual tray assembly 300 significantly increases the amount of proximate or intimate contact between the food item F and microwave energy interactive element 312 on the first tray 302 and the second tray 304, as compared with using a single tray.

Figure 4A:
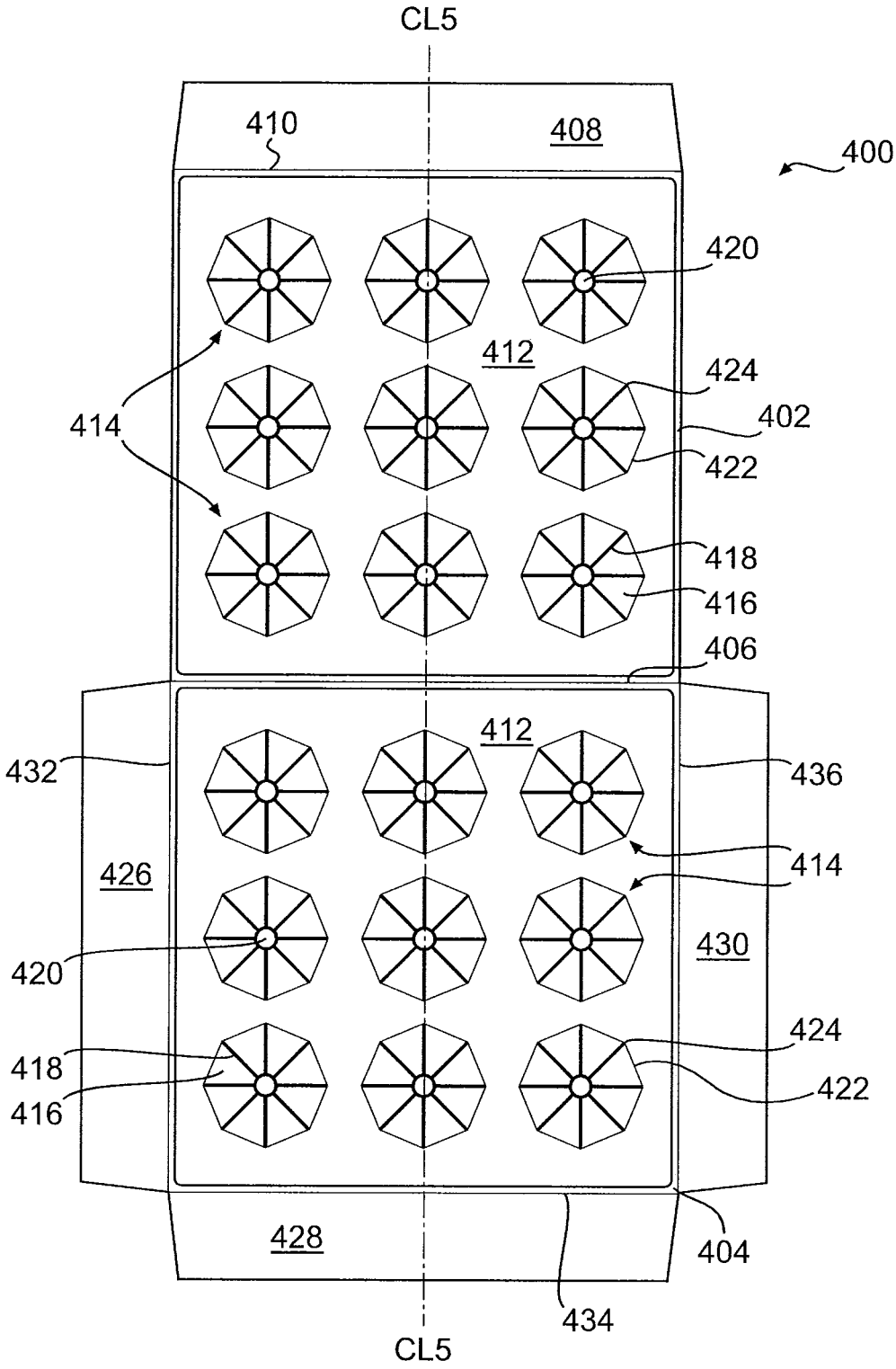
FIG. 4A depicts yet another exemplary blank that may be used to form a microwave energy interactive heating tray, according to various aspects of the present invention.

FIG. 4A presents another blank 400 that may be used in accordance with various aspects of the invention. The blank 400 is substantially symmetrical along a centerline CL5. In this example, the blank 400 includes a first major panel 402 joined to a second major panel 404 along a major fold line 406. An end panel 408 is joined to the second major panel 404 along a fold line 410. A microwave energy interactive element 412, for example, a susceptor film, independently overlies at least a portion of the first major panel 402 and at least a portion of the second major panel 404. It will be understood that although the microwave energy interactive element in the first major panel and the second major panel have been given the same reference numeral, the actual microwave energy interactive element used in each may be the same type of microwave energy interactive element or may be different, depending on the particular application.

The first major panel 402 and the second major panel 404 each include a plurality of flanged receiving elements 414. Each flanged receiving element 414 includes a plurality of flange segments 416 defined by a plurality of radially arranged slits 418. The flanged receiving elements 414 in the first major panel 402 and the flanged receiving elements 414 in the second major panel 404 are arranged in a substantially aligned, opposed relation along a line of symmetry defined by major fold line 406, such that the flanged receiving elements 414 in the first major panel 402 and the second major panel 404 are in a substantially superposed relation when the first major panel 402 is folded toward the second major panel 404 along major fold line 406, as shown in FIG. 4B.

Figure 4B:
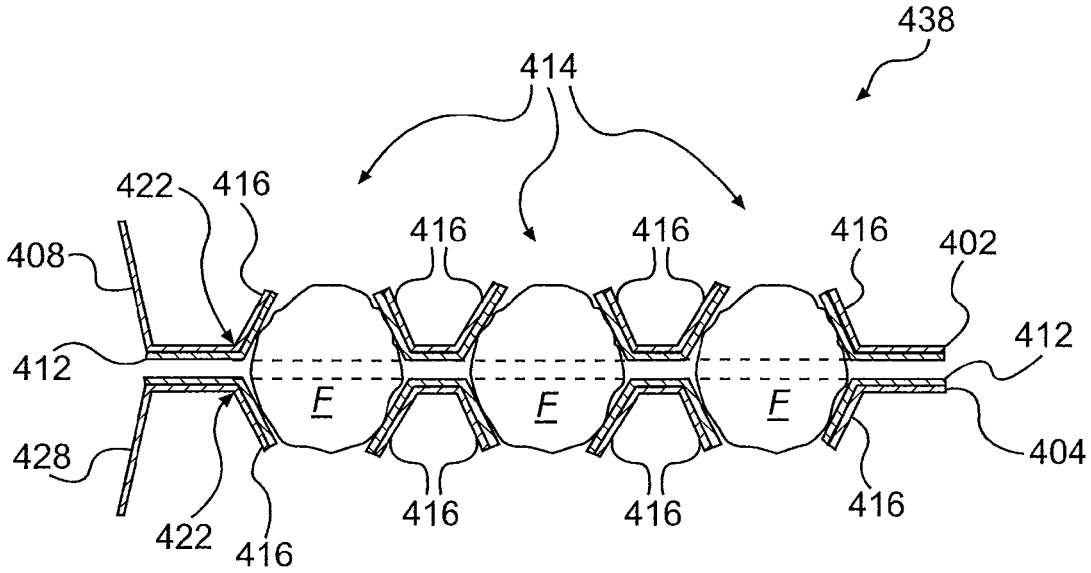
FIG. 4B depicts a microwave interactive heating tray formed from the exemplary blank of FIG. 4A, in use.

Still viewing FIG. 4B, the food item F seated within each flanged receiving element 414 is at least partially in intimate or proximate contact with the susceptor film 412 overlying the first major panel 402 and is at least partially in intimate or proximate contact with the susceptor film 412 overlying the second major panel 404. Thus, more of the surface of the food item F is available to be browned and/or crisped during microwave heating.

If desired, the radially arranged slits 418 may extend from a physical aperture 420 through the microwave energy interactive element 412 and the first and/or second major panel 402 or 404. Further, a fold line 422 may extend between the end points 424 of adjacent slits 418 that define each segment 416. Minor panels 426, 428, and 430 may extend from the second major panel 404 along respective fold lines 432, 434, and 436 to serve as support elements in a tray 438 formed from the blank 400.

To form the blank 400 into a tray (not shown), the first minor panel 426, the second minor panel 428, and the third minor panel 430 may be folded along the first minor fold line 432, the second minor fold line 434, and the third minor fold line 436, respectively, in a direction away from the microwave energy interactive element 412 on the second major panel 404. The first major panel 402 then may be folded toward the second major panel 404 along the major fold line 406. The folded panels 402 and 404 then may be positioned on a substantially planar surface (not shown) such that the folded first minor panel 426, the second minor panel 428, and the third minor panel 430 serve as support elements for the first major panel 402 and the second major panel 404. The tray 438 may be used much like that described in connection with FIGS. 3A and 3B, as shown schematically in FIG. 4B.

If desired, any of the numerous trays described herein or contemplated hereby may be provided in an outer carton. The food item to be heated therein may be provided within the tray and sealed using an overwrap, adhesive bonding, or any other locking mechanism. Alternatively, the food item may be provided in a separate sealed package, for example, a polymeric film pouch. In such a case, the user removes the food item from the film pouch and places each piece in the tray prior to heating in the microwave oven.

Figure 5:
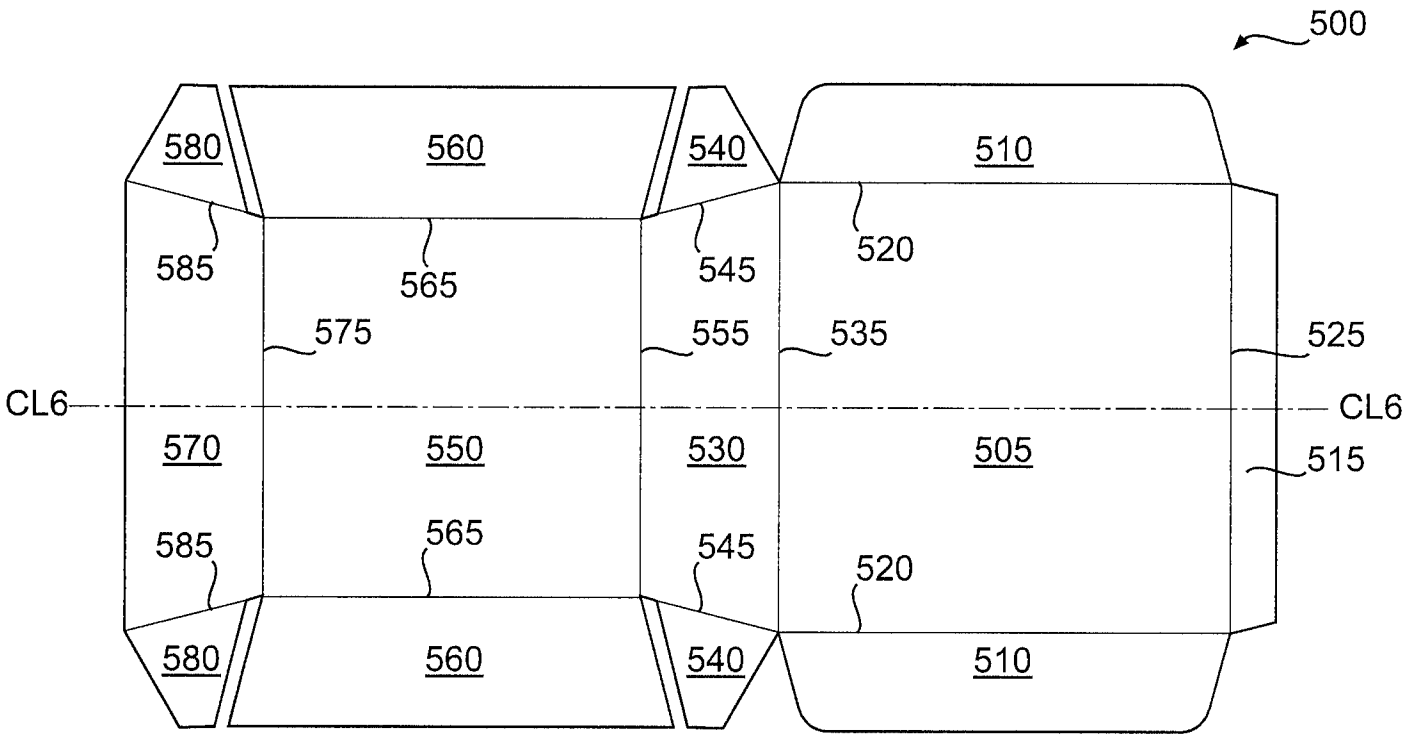
FIG. 5 depicts an exemplary blank that may be used to form a carton for use with a microwave energy interactive heating tray, according to various aspects of the present invention.

FIG. 5 depicts an exemplary blank 500 that may be used to form a carton according to various aspects of the present invention. The blank 500 is substantially symmetrical along a line of symmetry CL6. The blank 500 includes a top panel 505 having a pair of opposed side panels 510 and a glue flap 515 extending therefrom along respective fold lines 520 and 525. A back panel 550 is joined to the top panel 505 along a fold line 535. Glue flaps 540 extend from the back panel 550 along respective fold lines 545. The blank 500 also includes a bottom panel 550 joined to the back panel 530 along fold line 555. A pair of opposed side panels 560 are joined to the bottom panel 550 along respective fold lines 565. A front panel 570 is joined to the bottom panel 550 along a fold line 575. A pair of opposed glue flaps 580 extend from the front panel 570 along respective fold lines 585.

To form the blank 500 into a carton 590 (shown in FIGS. 6A and 6B), panels 530, 560, and 570 are folded inwardly along respective fold lines 535, 555, and 575 to form generally upstanding walls. Glue flaps 540 and 575 are folded inwardly along fold lines 545 and 580 and secured to the inner or outer surface of side panels 560 using an adhesive or other suitable securing feature. Panels 510 and 515 then are folded inwardly along respective fold lines 520 and 525. The top panel 505 then is brought toward the bottom panel 550 and secured adhesively or otherwise to form the carton 590. It will be understood that while the carton of this example and others herein are assembled using an adhesive, other thermal, chemical, or mechanical methods or techniques may be used to secure the panels. Additionally, it will be understood that in this and other aspects of the invention, various other methods, steps, and sequences may be used to manipulate the panels to form the carton.

Figure 6A:
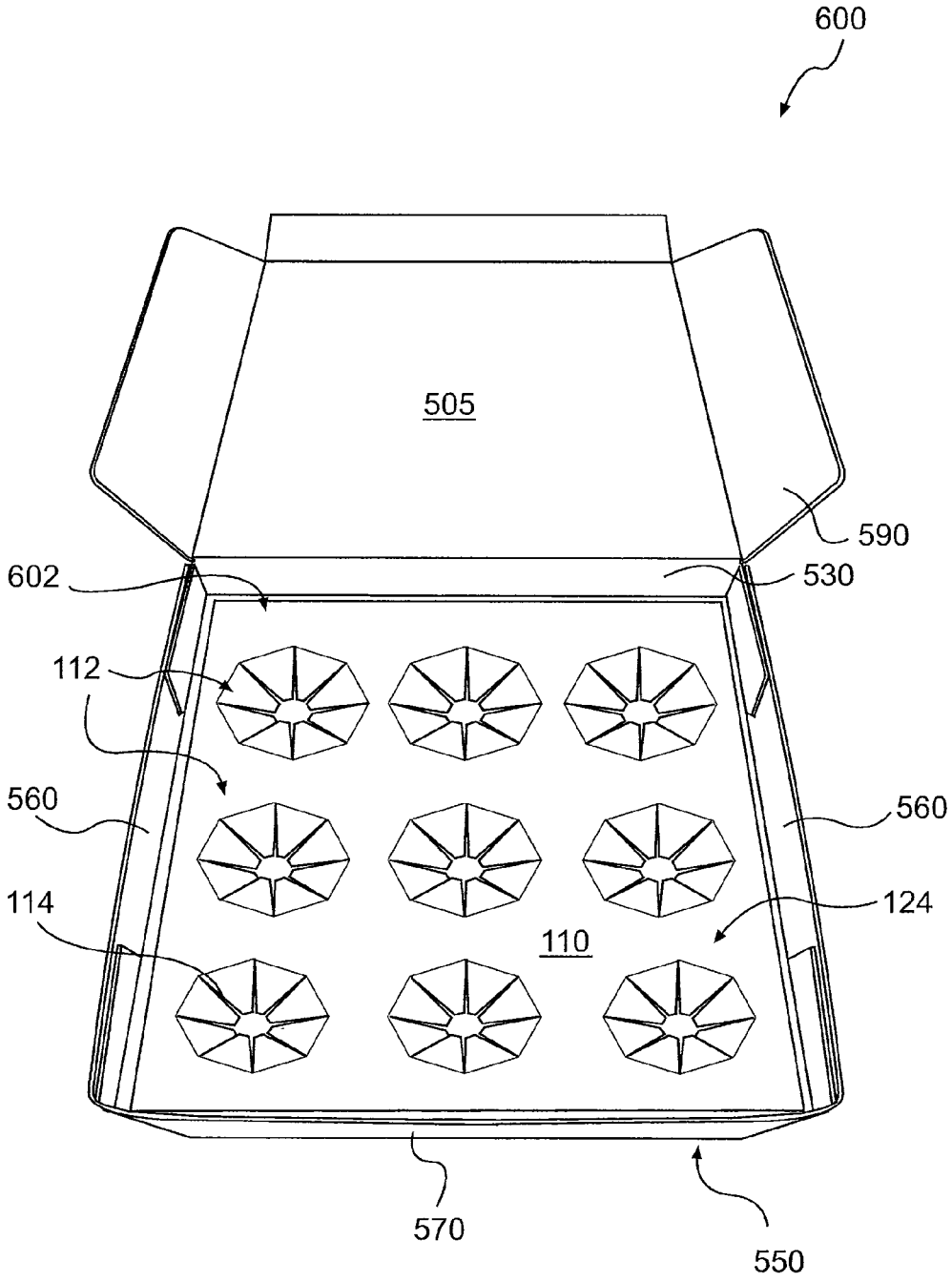
FIG. 6A depicts an exemplary microwave heating system according to various aspects of the present invention.
Figure 6B:
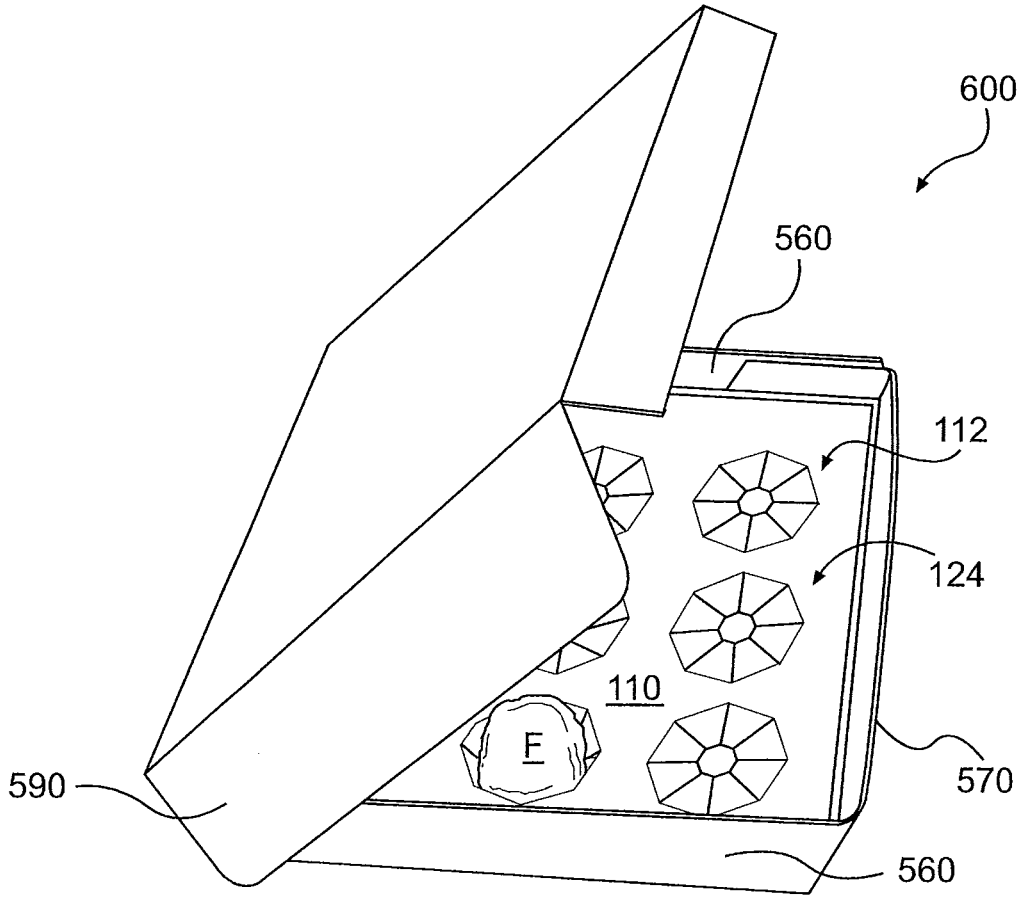
FIG. 6B depicts the exemplary microwave heating package of FIG. 6A in use.

FIGS. 6A and 6B depict an exemplary heating, browning, and/or crisping system or package 600 according to various aspects of the present invention. The system 600 generally includes a tray 124 for receiving the food item or items, for example, that shown in FIG. 1E, and a carton 590, for example, formed from the blank 500 of FIG. 5. The carton 590 generally includes a top panel 505, a bottom panel 550, and a plurality of side panels or walls 530, 560, and 570 extending between the top panel 505 and bottom panel 550 collectively defining an interior space 602. The tray 124 is dimensioned to be received within the interior space 602 of the carton 590. If desired, the tray 124 may be affixed to the bottom panel 550, back panel 530, side panels 560, and/or front panel 570 of the carton 590 to secure the tray 124 in position. Alternatively, the tray 124 may be seated removably within the carton 590.

To use the system 600, one or more rounded food items F (FIG. 6B) may be placed into the tray 124 in alignment with the various flanged receiving elements 112. As the food item is urged against the flange segments 114, the flange segments 114 fold toward the bottom panel 550 of the carton 590. In the fully seated position, the food item F is in intimate or proximate contact with the microwave energy interactive element 110 and remains suspended above the bottom panel 550 of the carton 590. The system 600 then may be placed in a microwave oven (not shown) according to instructions provided and the one or more food items F are heated and browned and/or crisped.

In this and other aspects of the invention, the carton may include a microwave energy interactive element overlying at least a portion of the top panel facing the interior space. Such cartons sometimes are referred to herein as "microwave energy interactive cartons". Any microwave energy interactive element may be used including, but not limited to, a susceptor or a microwave energy interactive insulating material.

As used herein, the term "microwave energy interactive insulating material" or "insulating material" refers any combination of layers of materials that is both responsive to microwave energy and capable of providing some degree of thermal insulation when used to heat a food item.

The insulating material may include various components, provided that each is resistant to softening, scorching, combusting, or degrading at typical microwave oven heating temperatures, for example, at about 250° F. The insulating material may include both microwave energy responsive or interactive components, and microwave energy transparent or inactive components. In one aspect, the insulating material comprises one or more susceptor layers in combination with one or more expandable insulating cells. Additionally, the insulating material may include one or more microwave energy transparent or inactive materials to provide dimensional stability, to improve ease of handling the microwave energy interactive material, and/or to prevent contact between the microwave energy interactive material and the food item. For example, the microwave energy interactive insulating material may comprise microwave energy interactive material supported on a first polymeric film layer, a moisture-containing layer superposed with the microwave energy interactive material and a second polymeric film layer joined to the moisture-containing layer in a predetermined pattern, thereby forming one or more closed cells between the moisture-containing layer and the second polymeric film layer. The closed cells expand or inflate in response to being exposed to microwave energy, and thereby causing microwave energy interactive material to bulge and deform.

Several exemplary insulating materials are depicted in FIGS. 7A-9. In each of the examples shown herein, it should be understood that the layer widths are not necessarily shown in perspective. In some instances, for example, the adhesive layers may be very thin with respect to other layers, but are nonetheless shown with some thickness for purposes of clearly illustrating the arrangement of layers.

Figure 7A:
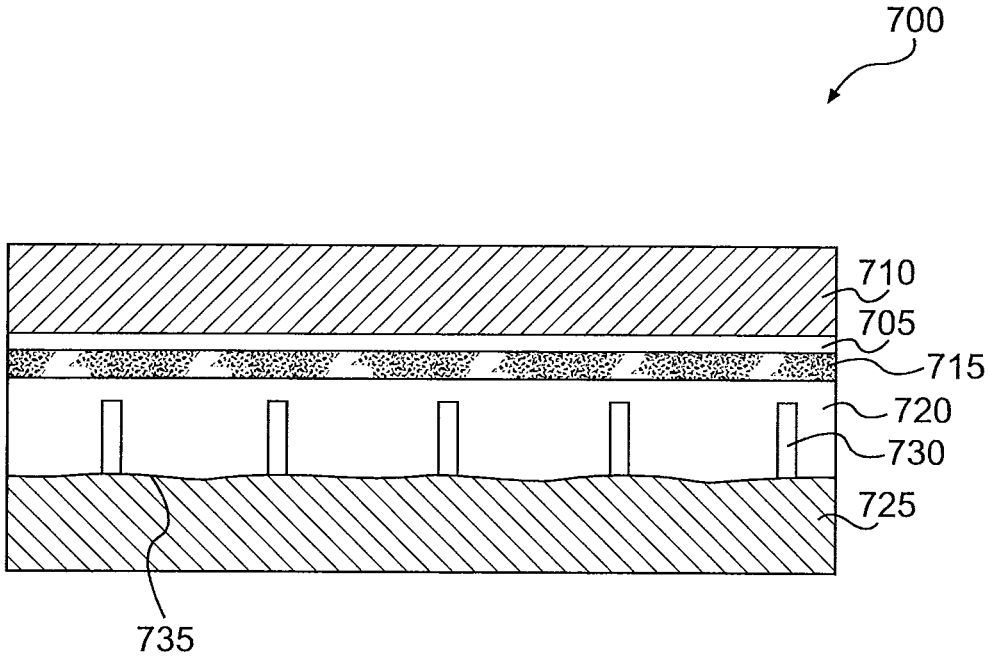
FIG. 7A depicts an exemplary microwave energy interactive insulating material for use with various aspects of the present invention.

Referring to FIG. 7A, the insulating material 700 may be a combination of several different layers. A susceptor film, which typically includes a thin layer of microwave energy interactive material 705 supported on a first polymer film 710, is bonded by lamination with an adhesive 785 (or otherwise)

to a dimensionally stable substrate 720, for example, paper. The substrate 720 is bonded to a second polymer film 725 using a patterned adhesive 730 or other material, such that closed cells 735 are formed in the material 700. The closed cells 735 are substantially resistant to vapor migration.

Figure 7B:
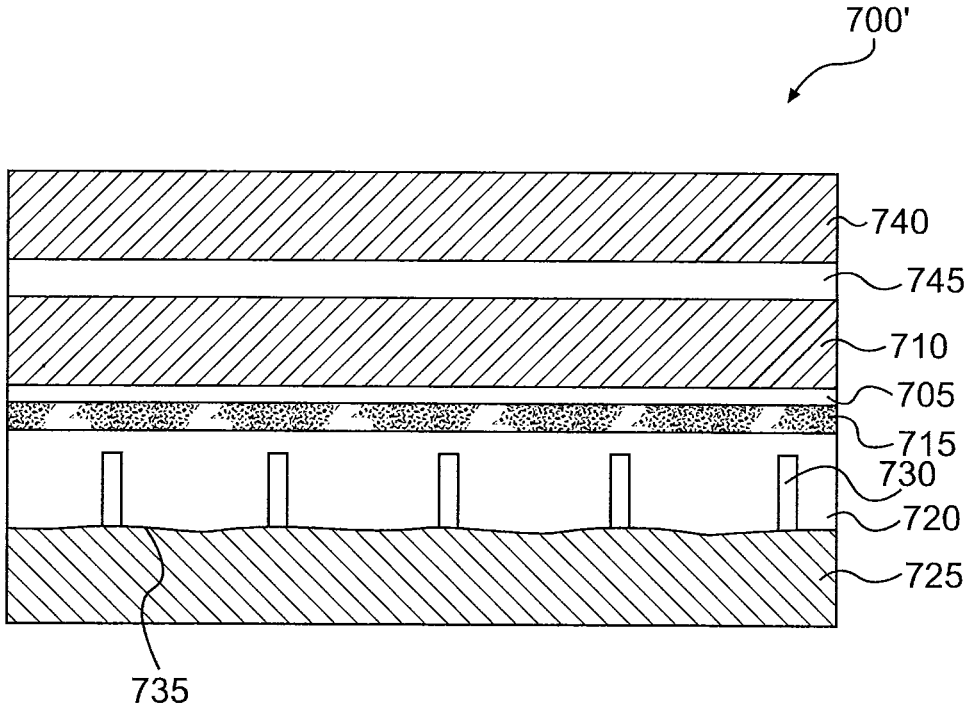
FIG. 7B depicts another exemplary microwave energy interactive insulating material for use with various aspects of the present invention.

Optionally, an additional microwave transparent layer 740 may be adhered by adhesive 745 or otherwise to the first plastic film 710 opposite the microwave energy interactive material 705, as depicted in FIG. 7B. The additional microwave transparent layer 740 may be a layer of paper, polymer film, or any other suitable material, and may be provided to shield the food item (not shown) from any flakes of susceptor film that craze and peel away from the insulating material 700' during heating.

Figure 7C:
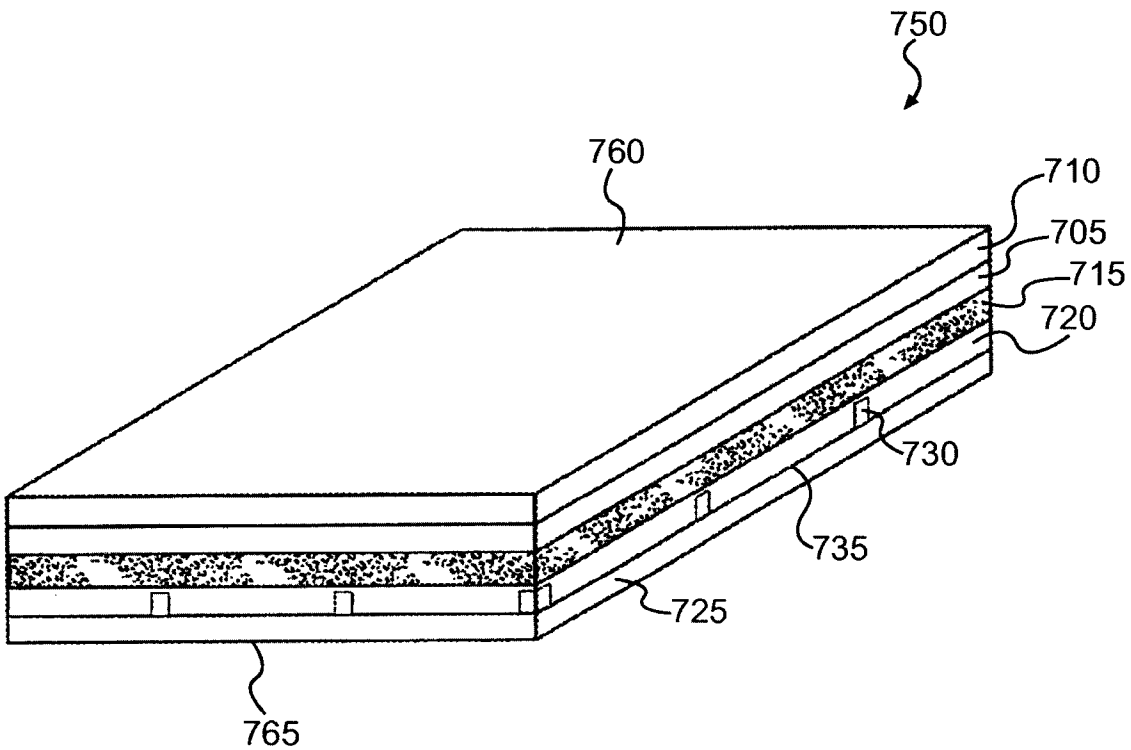
FIG. 7C depicts the exemplary microwave energy interactive insulating material of FIG. 7A in the form of a cut insulating sheet, for use with various aspects of the present invention.

The insulating material 700 may be cut and provided as a substantially flat, multi-layered sheet 750, as shown in FIG. 7C.

Figure 7D:
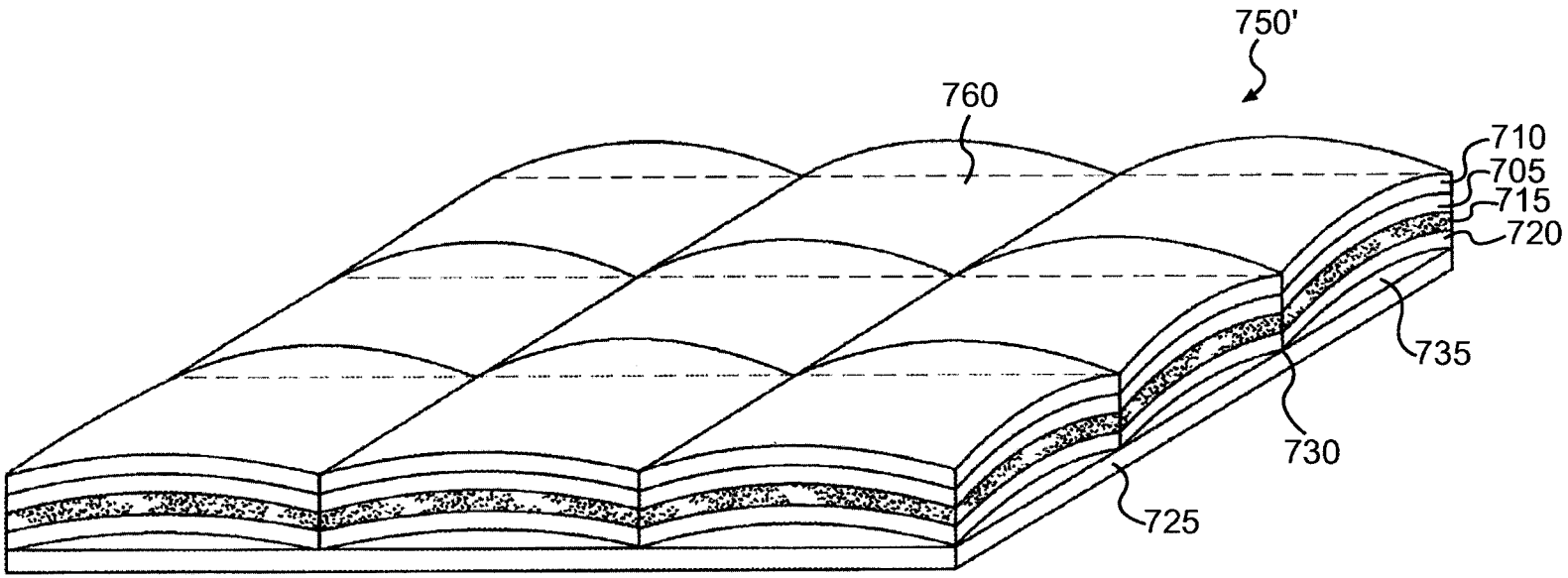
FIG. 7D depicts the insulating sheet of FIG. 7C upon exposure to microwave energy.

FIG. 7D depicts the exemplary insulating material 750 of FIG. 7B while being exposed to microwave energy from a microwave oven (not shown). As the susceptor heats upon impingement by microwave energy, water vapor and other gases typically held in the substrate 720, for example, paper, and any air trapped in the thin space between the second polymer film 725 and the substrate 720 in the closed cells 735, expand. The expansion of water vapor and air in the closed cells 735 applies pressure on the susceptor film 710 and the substrate 720 on one side and the second polymer film 725 on the other side of the closed cells 735. Each side of the material 700 forming the closed cells 735 reacts simultaneously, but uniquely, to the heating and vapor expansion. The cells 735 expand or inflate to form a quilted top surface 760 of pillows separated by channels (not shown) in the susceptor film 710 and substrate 720 lamination, which lofts above a bottom surface 765 formed by the second polymer film 725. This expansion may occur within 1 to 100 seconds in an energized microwave oven and, in some instances, may occur within 2 to 10 seconds. The resulting insulating material 750' has a quilted or pillowed appearance. When microwave heating has ceased, the quilts typically deflate and return to a somewhat flattened state.

In another aspect, the insulating material comprises a durably expandable insulating material. As used herein, the term "durably expandable insulating material" or "durably expandable material" refers to a microwave energy interactive insulating material that includes expandable insulating cells that tend to remain at least partially expanded after exposure to microwave energy has been terminated. In some instances, the cells may remain substantially expanded after exposure to microwave energy has been terminated.

In one example, the durably expandable material comprises one or more reagents or additives that release a gas upon exposure to microwave energy. For example, the additive may comprise a combination of sodium bicarbonate ($NaHCO_3$) and a suitable acid, which react to form carbon dioxide. As the carbon dioxide is released, the gas causes the cells to expand. While certain reagents and gases are described herein, it will be understood that other reagents and released gases are contemplated hereby. The reagents may be incorporated into the durably expandable material in any suitable manner and, in some instances, are coated as a dispersion or a latex onto all or a portion of one or more layers adjacent the expandable cells.

In one example, the durably expandable material comprises a combination of several different layers. A susceptor that includes a thin layer of microwave interactive material on a first polymer film is bonded, for example, by lamination with an adhesive, to a dimensionally stable substrate, for example, paper. The substrate is bonded to a second polymer film using a patterned adhesive or other material, such that closed cells are formed in the material. The closed cells are substantially resistant to vapor migration. A coating including one or more reagents that generate a gas upon exposure to microwave energy covers all or a portion of the microwave energy interactive material. Alternatively, the coating may be applied to the substrate.

As the susceptor heats upon impingement by microwave energy, water vapor and other gases normally held in the substrate, for example, paper, and any air trapped in the thin space between the second polymer film and the substrate in the closed cells, expand. The expansion of water vapor and air in the closed cells applies pressure on the susceptor film and the substrate on one side and the second polymer film on the other side of the closed cells. Additionally, depending on the particular reagents selected, the presence of water vapor and/or heat may initiate the reaction between the reagents. Each side of the material forms the closed cells reacts simultaneously, but uniquely, to the heating and vapor expansion. The cells expand or inflate to form a quilted top surface of cells separated by channels in the susceptor film and substrate lamination, which lofts above a bottom surface formed by the second plastic film. This expansion may occur within 1 to 15 seconds in an energized microwave oven, and in some instances, may occur within 2 to 10 seconds. After the exposure to microwave energy has been terminated, the cells remain inflated.

In this and other aspects, the exemplary insulating materials contemplated hereby provide several benefits before, during, and after heating in a microwave oven. First, the water vapor, air, and other gases contained in the closed cells provides insulation between the food item and the ambient environment of the microwave oven. The base of a microwave oven, for example, the glass tray found in most microwave ovens, acts as a large heat sink, absorbing much of the heat generated by the susceptor film or within the food item itself. The vapor pockets in the cells formed by the present invention may be used to insulate the food item and susceptor film from the microwave oven surfaces and the vented air in the microwave oven cavity, thereby increasing the amount of heat that stays within or is transferred to the food item.

Second, the formation of the cells allows the material to conform more closely to the surface of the food item, placing the susceptor film in greater proximity to the food item. This enhances the ability of the susceptor film to brown and crisp the surface of the food item by conduction heating, in addition to some convection heating, of the food item.

It will be appreciated that the various insulating materials used in accordance with the present invention enhances the heating, browning, and crisping of a food item adjacent thereto. By using insulating cells in cooperation with a susceptor, more of the sensible heat generated by the susceptor is transferred to the surface of the food item rather than to the microwave oven environment. Without the insulating material, some or all the heat generated by the susceptor may be lost via conduction to the surrounding air and other conductive media, such as the microwave oven floor or turntable. Thus, more of the sensible heat generated by the susceptor is directed to the food item and browning and crisping is enhanced. Furthermore, insulating materials may help to retain moisture in the food item when cooking in the microwave oven, thereby improving the texture and flavor of the food item. Additional benefits and aspects of such materials are described in PCT Application No. PCT/US03/03779, U.S. Pat. No. 7,019,271, and U.S. Pat. No. 7,351,942, each of which is incorporated by reference herein in its entirety.

It will be understood by those of skill in the art that any of the insulating materials described herein or contemplated hereby may include an adhesive pattern that is selected to enhance cooking of a particular food item. For example, where the food item is a larger item, the adhesive pattern may be selected to form substantially uniformly shaped expandable cells. Where the food item is a small item, the adhesive pattern may be selected to form a plurality of different sized cells to allow the individual items to be variably contacted on their various surfaces. While several examples are provided herein, it will be understood that numerous other patterns are contemplated hereby, and the pattern selected will depend on the heating, browning, crisping, and insulating needs of the particular food item and package.

If desired, multiple layers of insulating materials may be used to enhance the insulating properties of the various heating sheets and other constructs described herein or contemplated hereby and, therefore, enhance the browning and crisping of the food item. Where multiple layers are used, the layers may remain separate or may be joined using any suitable process or technique, for example, thermal bonding, adhesive bonding, ultrasonic bonding or welding, mechanical fastening, or any combination thereof. In one example, two sheets of an insulating material may be arranged so that their respective susceptor layers are facing away from each other. In another example, two sheets of an insulating material may be arranged so that their respective susceptor layers are facing towards each other. In still another example, multiple sheets of an insulating material may be arranged in a like manner and superposed. In a still further example, multiple sheets of various insulating materials are superposed in any other configuration as needed or desired for a particular application. The multi-layer material or structure then can be used to form, or can be used in cooperation with, a tray, carton, system, or other construct according to the present invention.

Figure 8:
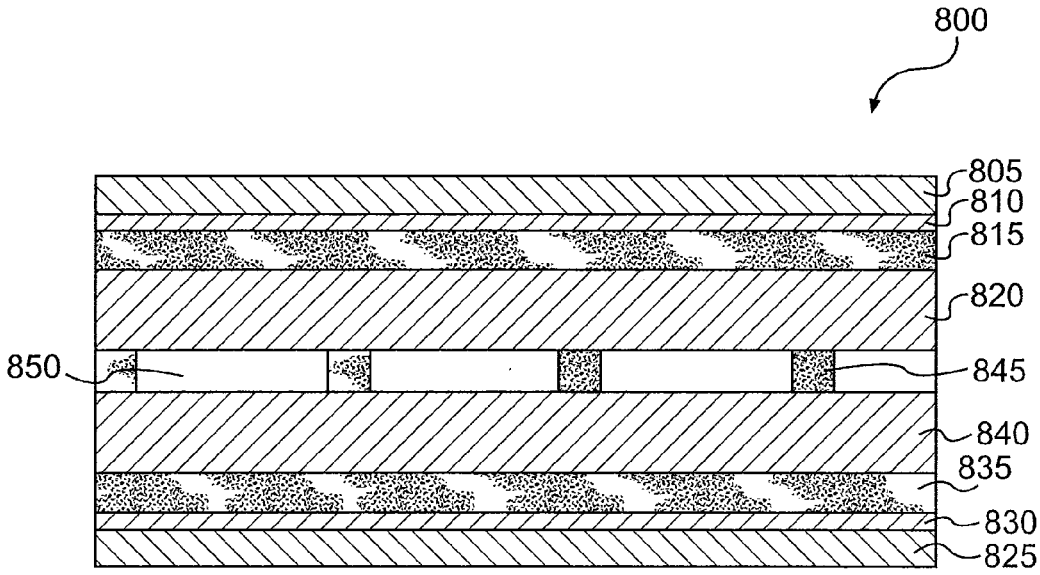
FIG. 8 depicts another exemplary microwave energy interactive insulating material for use with various aspects of the present invention.
Figure 9:
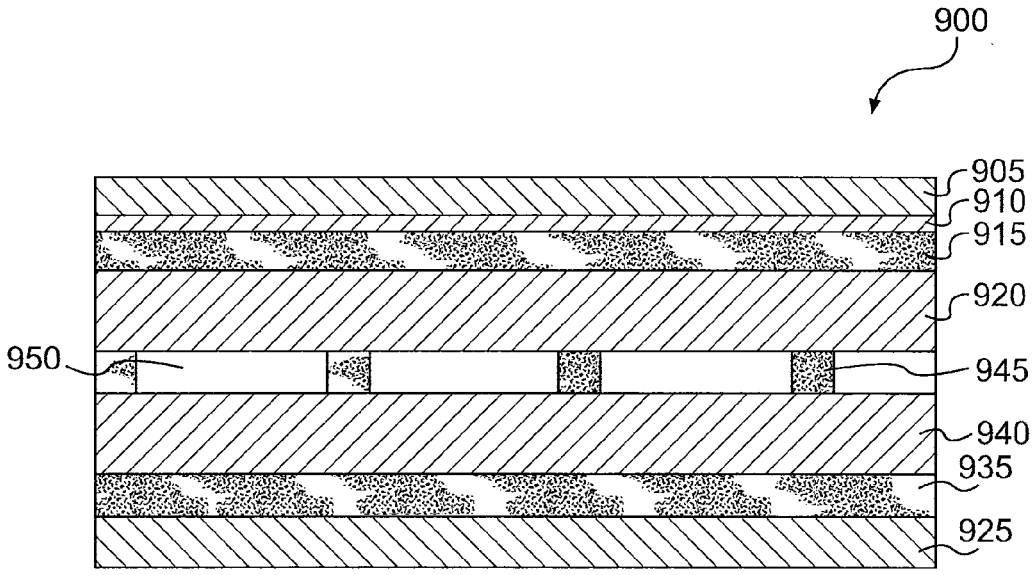
FIG. 9 depicts yet another exemplary microwave energy interactive insulating material for use with various aspects of the present invention.

FIGS. 8 and 9 depict other exemplary microwave energy interactive insulating materials according to various aspects of the present invention. Referring first to FIG. 8, an insulating material 800 is shown with two symmetrical layer arrangements adhered together by a patterned adhesive layer. The first symmetrical layer arrangement, beginning at the top of the drawings, comprises a polymer film layer 805 (e.g., polyethylene terephthalate, i.e., PET), a metal layer 810, an adhesive layer 815, and a paper or paperboard layer 820. The metal layer 810 may comprise a metal, such as aluminum, deposited along at least a portion of the polymer film layer 805. The polymer film 805 and metal layer 810 together define a susceptor film. The adhesive layer 815 joins the polymer film 805 and the metal layer 810 to the paperboard layer 820.

The second symmetrical layer arrangement, beginning at the bottom of the drawings, also comprises a polymer film layer 825 (e.g., PET), a metal layer 830, an adhesive layer 835, and a paper or paperboard layer 840. If desired, the two symmetrical arrangements may be formed by folding one layer arrangement onto itself. The layers of the second symmetrical layer arrangement are bonded together in a similar manner as the layers of the first symmetrical arrangement. A patterned adhesive layer 845 is provided between the two paper layers 820 and 840, and defines a pattern of closed cells 850 configured to expand when exposed to microwave energy. It has been discovered that an insulating material 800 having two metal layers 810 and 830 according to the present invention generates more heat and greater cell loft. As a result, such a material is able to elevate a food item seated thereon to a greater extent than an insulating material having a single microwave energy interactive material layer.

Referring to FIG. 9, yet another insulating material 900 is shown. The material 900 includes a polymer film layer 905 (e.g., PET), a metal layer 910, an adhesive layer 915, and a paper layer 920. Additionally, the material 900 may include a polymer film layer 925 (e.g., PET), an adhesive 935, and a paper layer 940. The layers are adhered or affixed by a patterned adhesive 945 defining a plurality of closed expandable cells 950.

Figure 10:
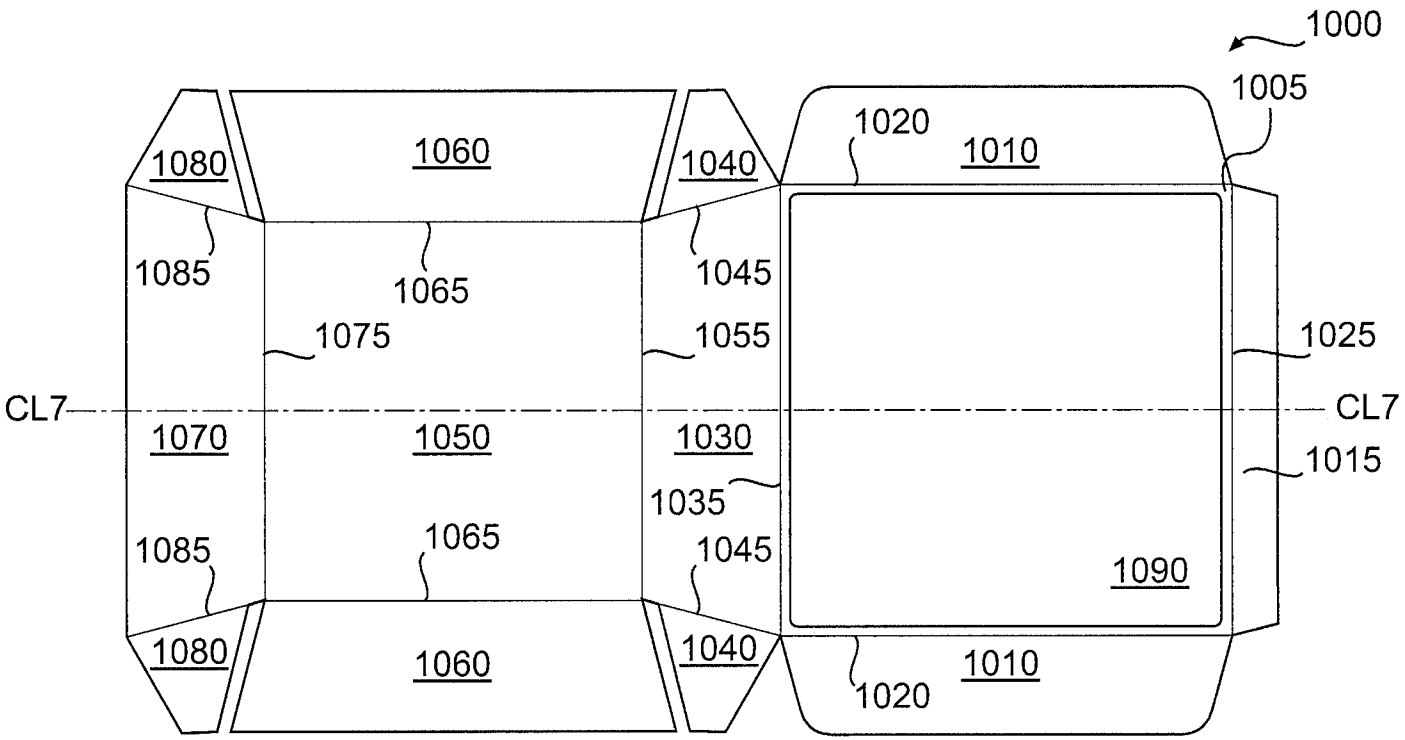
FIG. 10 depicts yet another exemplary blank that may be used to form a microwave interactive carton for use with a microwave energy interactive heating tray, according to various aspects of the present invention.

Turning to FIG. 10, an exemplary blank 1000 for forming a microwave energy interactive carton 1095 (FIGS. 11A and 11B) is illustrated. The blank 1000 is substantially symmetrical along a line of symmetry CL7. The blank 1000 includes a top panel 1005 having a pair of opposed side panels 1010 and a glue flap 1015 extending therefrom along respective fold lines 1020 and 1025. A back panel 1030 is joined to the top panel 1005 along a fold line 1035. Glue flaps 1040 extend from the back panel 1030 along respective fold lines 1045. The blank 1000 also includes a bottom panel 1050 joined to the back panel 1030 along fold line 1055. A pair of opposed side panels 1060 are joined to the bottom panel 1050 along respective fold lines 1065. A front panel 1070 is joined to the bottom panel 1050 along a fold line 1075. A pair of opposed glue flaps 1080 extend from the front panel 1070 along respective fold lines 1085.

A microwave energy interactive element 1090 overlies at least a portion of the top panel 1005. In this example, the microwave energy interactive element 1090 is a susceptor film. However, other microwave energy interactive elements may be used with the present invention.

To form the blank 1000 into a carton 1095 (shown in FIGS. 11A and 11B), panels 1030, 1060, and 1070 are folded inwardly along respective fold lines 1035, 1055, and 1075 to form generally upstanding walls. Glue flaps 1040 and 1075 are folded inwardly along fold lines 1045 and 1080 and secured to the side panels 1060 using an adhesive or other suitable securing feature. Panels 1010 and 1015 then are folded inwardly along respective fold lines 1020 and 1025. The top panel 1005 then is brought toward the bottom panel 1050 and secured adhesively or otherwise to form the carton 1095.

Figure 11A:
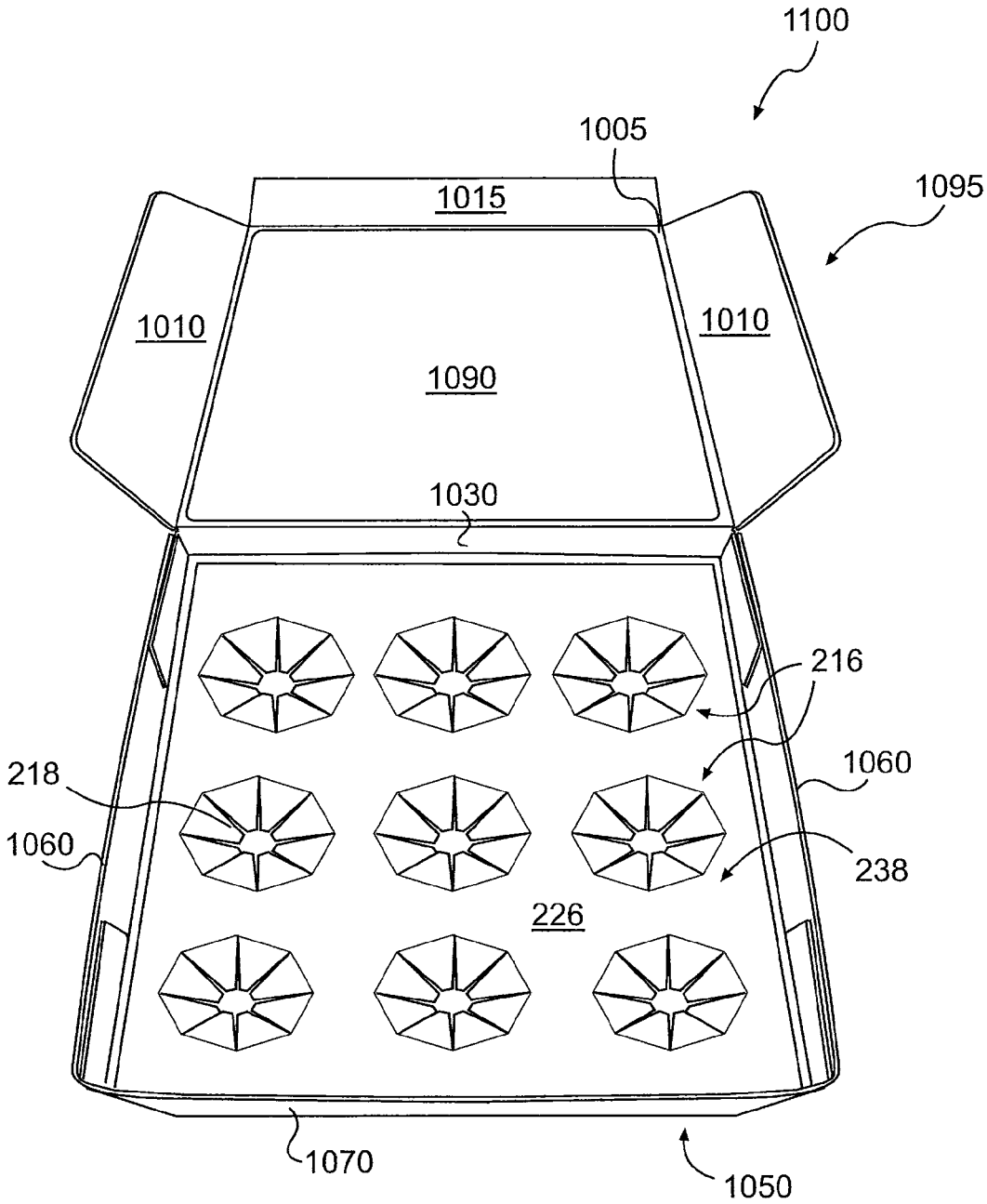
FIG. 11A depicts another exemplary microwave heating system according to various aspects of the present invention.
Figure 11B:
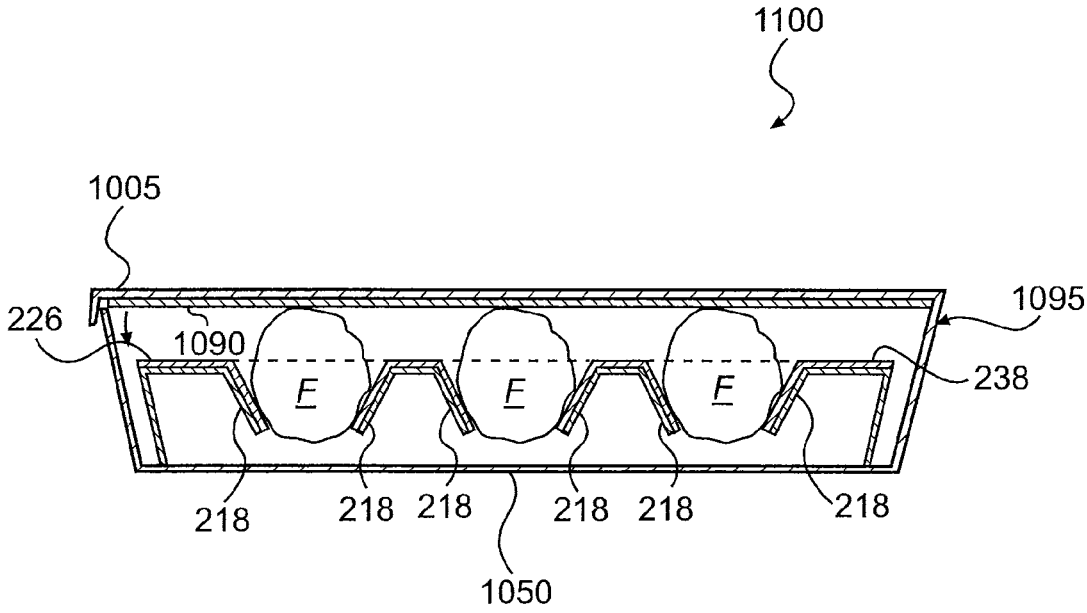
FIG. 11B depicts the microwave heating package of FIG. 11A in use.

FIGS. 11A and 11B illustrate another exemplary heating system or package 1100 according to various aspects of the present invention. The system 1100 includes a carton, for example, carton 1095 formed from the blank 1000 of FIG. 10, and at least one heating tray, for example, tray 238 of FIG. 2B, seated therein. As with the various other systems described herein, the tray 238 may be affixed to the carton 1095 or may remain separate therefrom.

To use the system 1100, one or more rounded food items F may be placed into the tray 238 and urged against the various flange receiving elements 216. In doing so, the food item F applies a force against the flange segments 218 and causes the flange segments 218 to deflect toward the bottom panel 1050 of the carton 1095. In the fully seated position, at least a portion of the food item F rests against the microwave energy interactive element 226 and remains suspended above the bottom panel 1050 of the carton 1095.

The top panel 1005 then is brought toward the bottom panel 1050 such that the microwave energy interactive element 1090 is brought into proximate or intimate contact with the upper portion of the food item F. The system 1100 then is placed in a microwave oven (not shown) according to instructions provided and the one or more food items F are heated and browned and/or crisped. In this example, the use of a microwave energy interactive element on both the tray and the top panel further enhances the browning and/or crisping of the surface of the food item.

Figure 12:
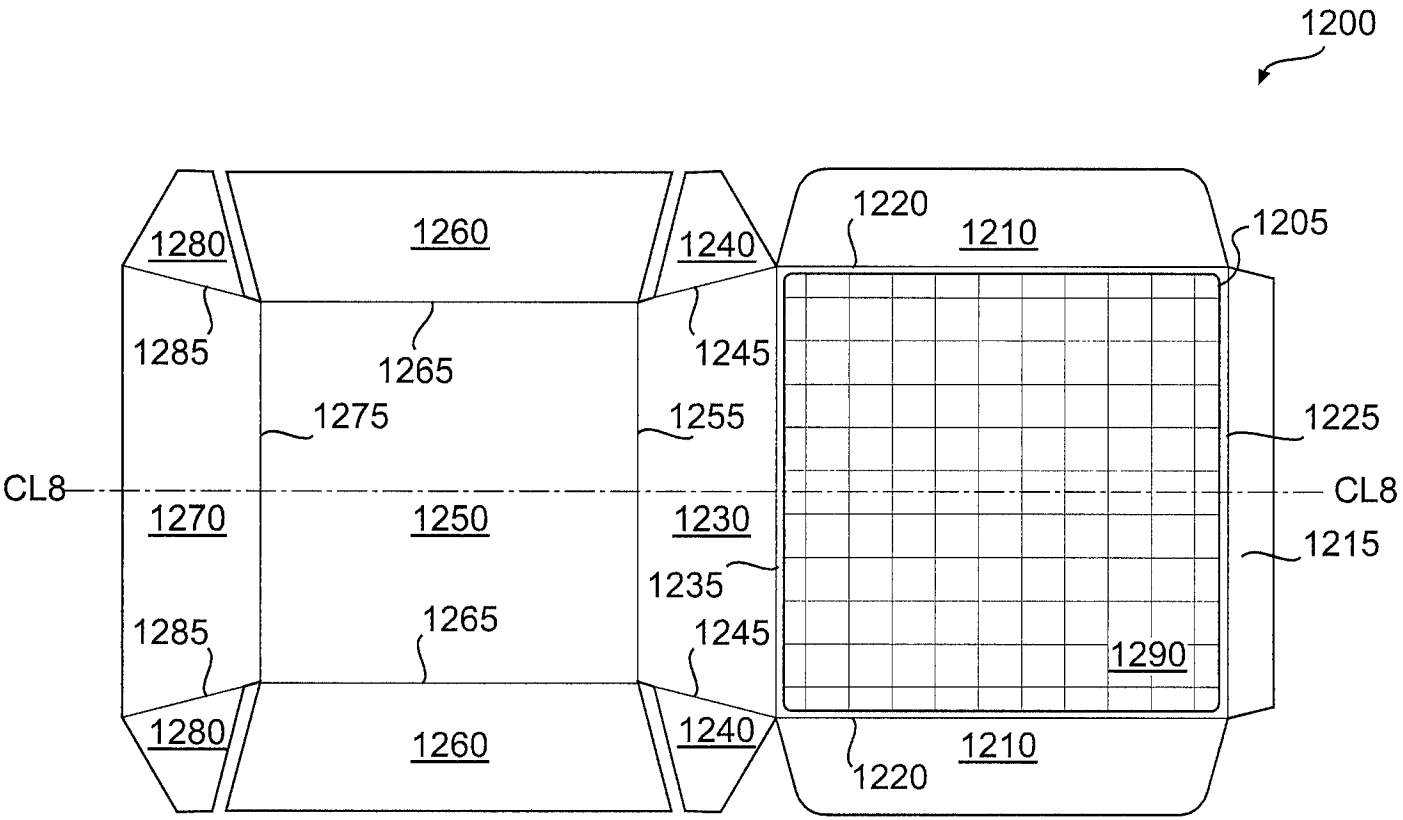
FIG. 12 depicts another exemplary blank that may be used to form a carton for use with a microwave energy interactive heating tray, according to various aspects of the present invention.

FIG. 12 depicts another exemplary blank 1200 that may be used according to various aspects of the present invention. The blank 1200 is substantially symmetrical along a line of symmetry CL8. The blank 1200 includes a top panel 1205 having a pair of opposed side panels 1210 and a glue flap 1215 extending therefrom along respective fold lines 1220 and 1225. A back panel 1230 is joined to the top panel 1205 along a fold line 1235. Glue flaps 1240 extend from the back panel 1230 along respective fold lines 1245. The blank 1200 also includes a bottom panel 1250 joined to the back panel 1230 along fold line 1255. A pair of opposed side panels 1260 are joined to the bottom panel 1250 along respective fold lines 1265. A front panel 1270 is joined to the bottom panel 1250 along a fold line 1255. A pair of opposed glue flaps 1280 extend from the front panel 1270 along respective fold lines 1285.

A microwave energy interactive element 1290 overlies at least a portion of the top panel 1205. In this example, the microwave energy interactive element 1290 comprises an expandable cell insulating material. However, other microwave energy interactive elements may be used with the present invention.

To form the blank 1200 into a carton 1295 (shown in FIGS. 13A and 13B), panels 1230, 1260, and 1270 are folded inwardly along respective fold lines 1255, 1265, and 1275 to form generally upstanding walls. Glue flaps 1240 and 1280 are folded inwardly along fold lines 1245 and 1285 and secured to the side panels 1260 using an adhesive or other suitable securing feature. Panels 1210 and 1215 then are folded inwardly along respective fold lines 1220 and 1225. The top panel 1205 then is brought toward the bottom panel 1250 and optionally secured adhesively or otherwise to form the carton 1295.

Figure 13A:
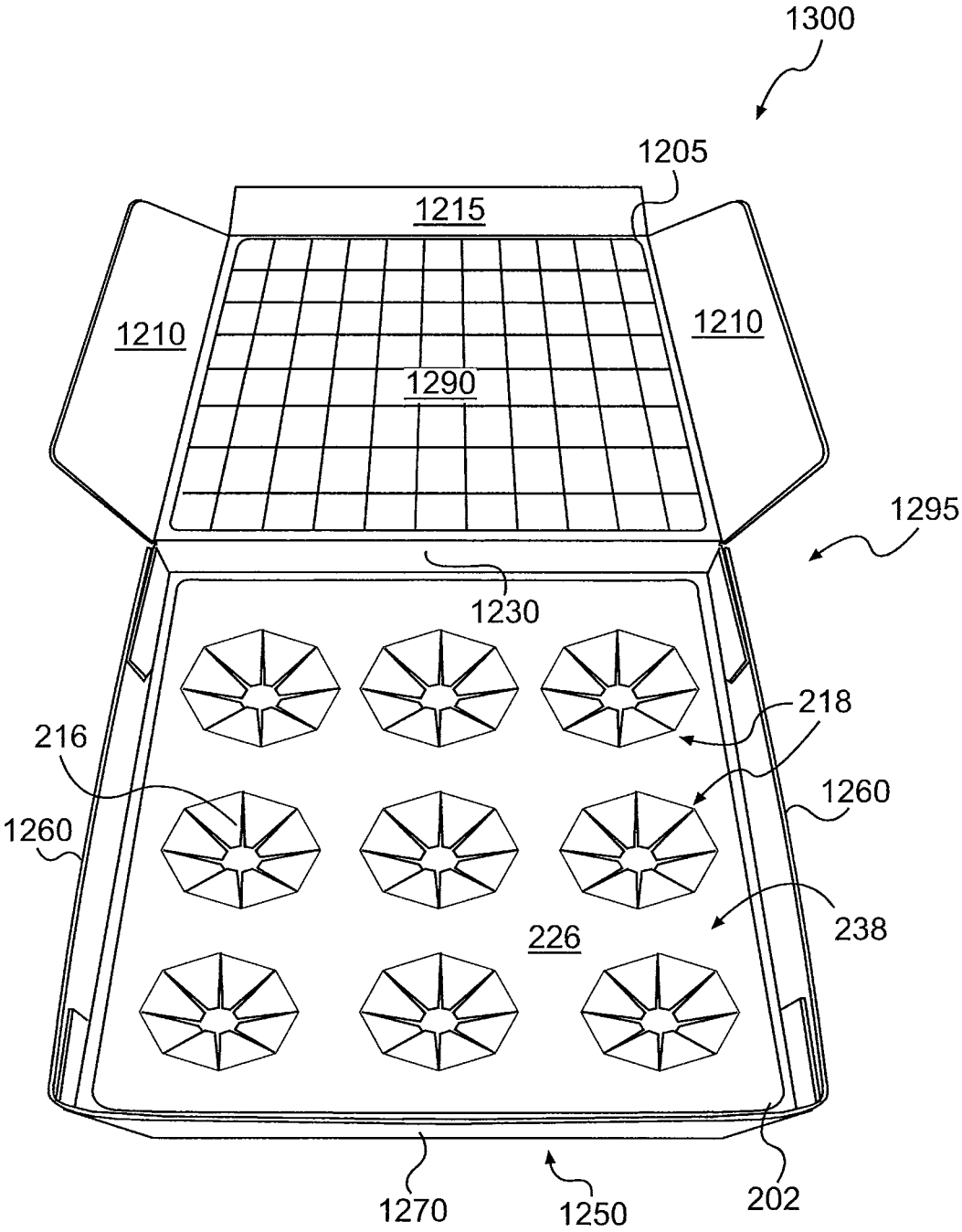
FIG. 13A depicts an exemplary carton formed from the blank of FIG. 12, that may be used with a microwave heating system according to various aspects of the present invention.
Figure 13B:
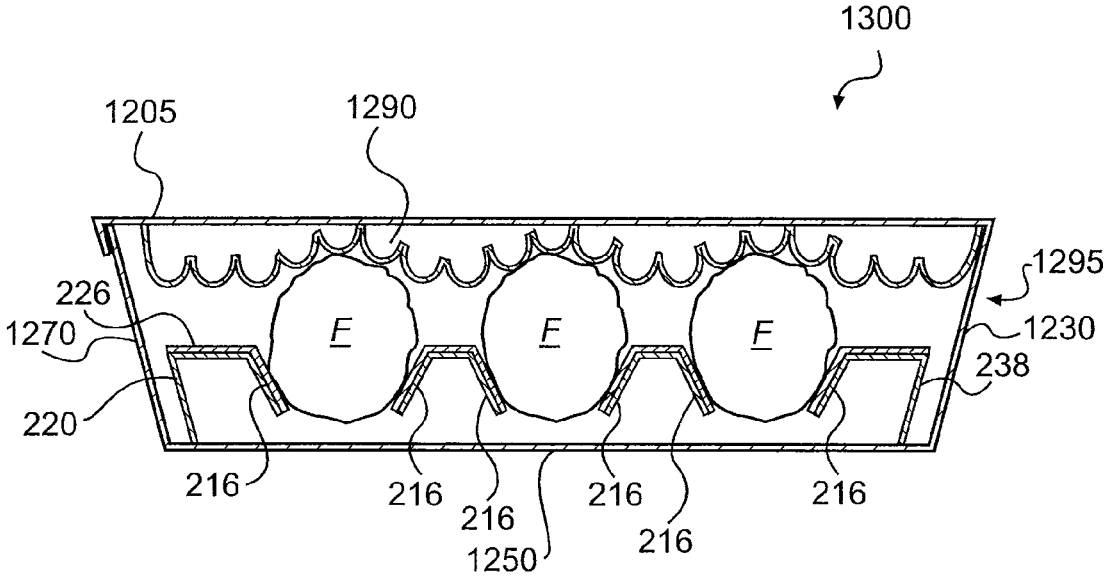
FIG. 13B illustrates the carton of FIG. 13A in use.

FIGS. 13A and 13B illustrate another exemplary heating system or package 1300 according to various aspects of the present invention. The system 1300 includes a carton, for example, carton 1295 formed from the blank 1200 of FIG. 12, and at least one heating tray, for example, tray 238 of FIG. 2B, seated therein. As with the various other systems described herein, the tray 238 may be affixed to the carton 1295 or may remain separate therefrom.

To use the system 1300, one or more rounded food items F may be urged against the various receiving elements 216 in the tray 238 to cause the flange segments 218 to fold toward the bottom panel 1250 of the carton 1295. In the fully seated position, the food item F rests against the microwave energy interactive element 226 and remains suspended above the bottom panel 1250 of the carton 1295.

The top panel 1205 then is brought toward the bottom panel 1250 such that the microwave energy interactive element 1290 is brought into proximate contact with the upper portion of the food item F. The system 1300 then is placed in a microwave oven (not shown) according to instructions provided and the one or more food items F are heated and browned and/or crisped. Upon exposure to microwave energy, the insulating material 1290 expands and bulges toward the food item F, as shown in FIG. 13B. As a result, the food item F is pressed toward the microwave energy interactive element 226 on the tray 238. Additionally, the expanded insulating material 1290 is able to conform to the surface of the food item F, thereby providing closer proximity with the susceptor therein. As a result, the browning and/or crisping of the surface of the food item may be enhanced.

Figure 14:
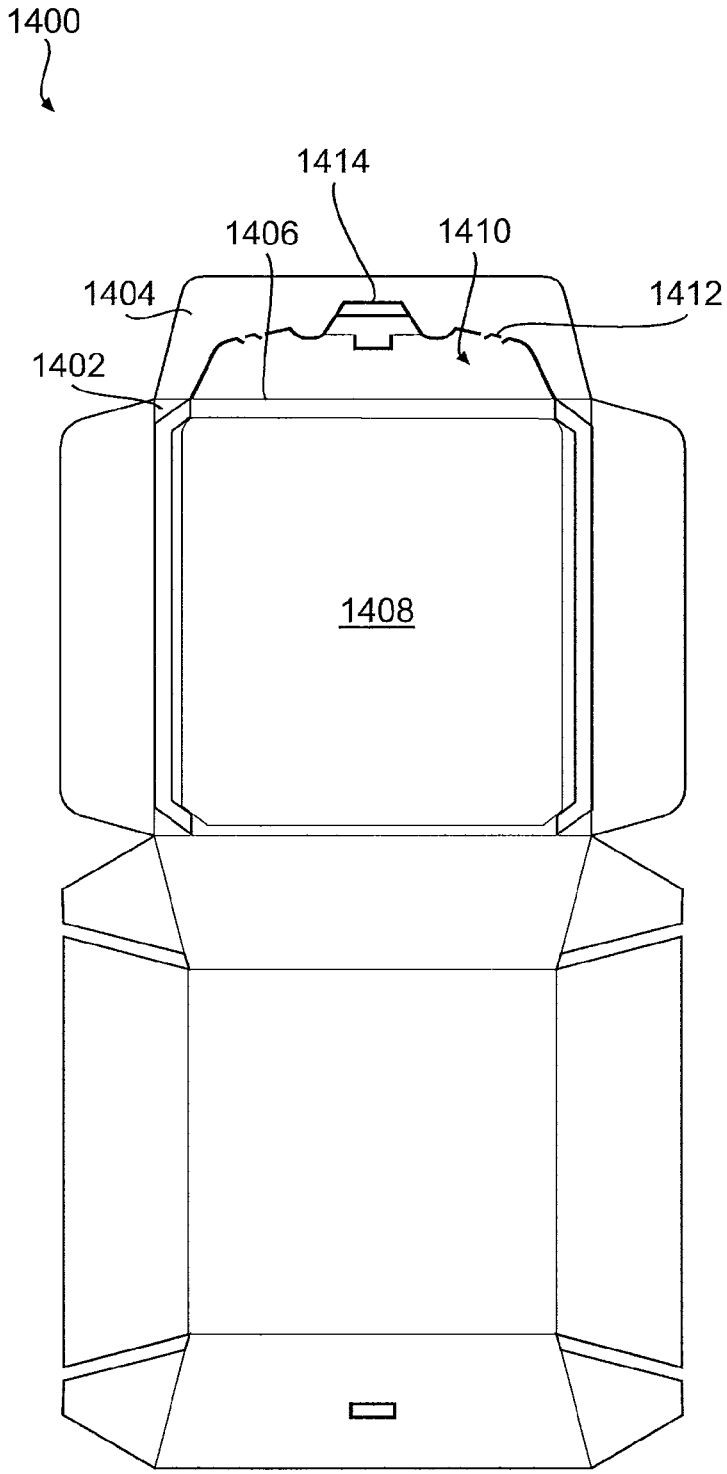
FIG. 14 depicts still another exemplary blank that may be used to form a microwave interactive carton for use with a microwave energy interactive heating tray, according to various aspects of the present invention.

While a particular carton and tray are used in this example, it will be understood that numerous other one piece, multipiece, top loading, and end loading cartons, and other cartons and trays may be used in any combination in accordance with the invention. For example, FIG. 14 illustrates another exemplary blank 1400 that may be suitable for use with the present invention. The blank 1400 includes a top panel 1402 joined to an end panel 1404 along a fold line 1406. A microwave interactive element 1408, for example, a susceptor or an insulating material, overlies at least a portion of the inner surface of the top panel 1402. A removable portion 1410 including at least a portion of the top panel 1402 and at least a portion of the end panel 1404 is defined by a tear line 1412. The removable portion 1410 includes a tab 1414 that can be gripped and pulled by a user to tear the removable portion 1410 and separate the portion 1410 at least partially from the remainder of the carton (not shown). Thus, the removable portion 1410 may be removed at least partially from the remainder of the carton after the food item or items are heated to access the food item or items therein. While one exemplary removable portion is shown herein, it will be understood that numerous variations thereof are contemplated hereby.

As discussed above, the various blanks and/or cartons may have any suitable shape, number, and/or configuration of receiving elements. In yet another example schematically illustrated in FIG. 15A, a receiving element or receptacle 1500 (shown in isolation) may have a generally elongate shape for receiving an elongated item F (shown with dashed lines), for example, an egg roll, pizza roll, burrito, taquito, or sandwich. As with the various other receiving elements illustrated herein, the receiving element or receptacle 1500 may include a plurality of tabs or flange segments 1502 that comprise microwave energy interactive material 1504 (shown generally with stippling). The tabs or flange segments may flex or hinge along lines of disruption 1506 to bring the microwave energy interactive material 1504 into closer proximity to the surface of the food item F. If desired, the receptacle optionally may include an aperture or opening 1508 within the receptacle 1500, and in some cases, the aperture or opening 1508 may be substantially centered within the receptacle.

Figure 15A:
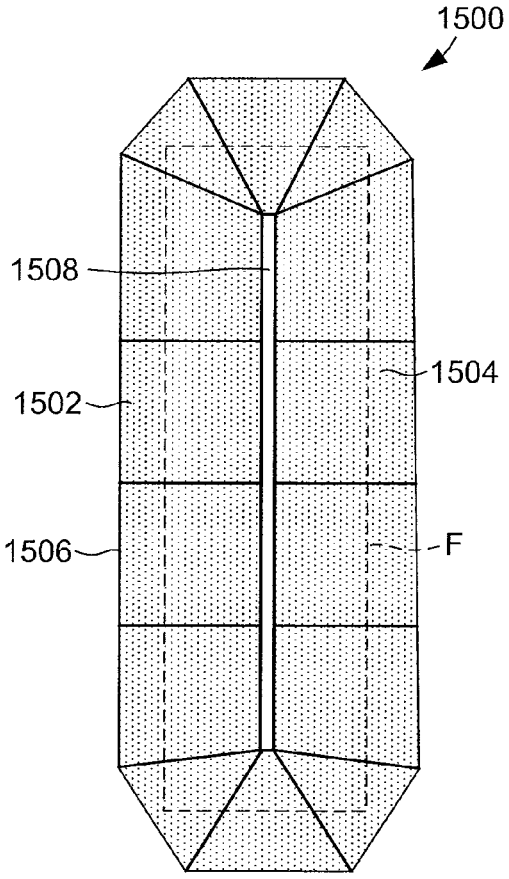
FIGS. 15A and 15B schematically illustrate top plan views of exemplary elongate receiving elements or receptacles, in isolation, with a food item.
Figure 15B:
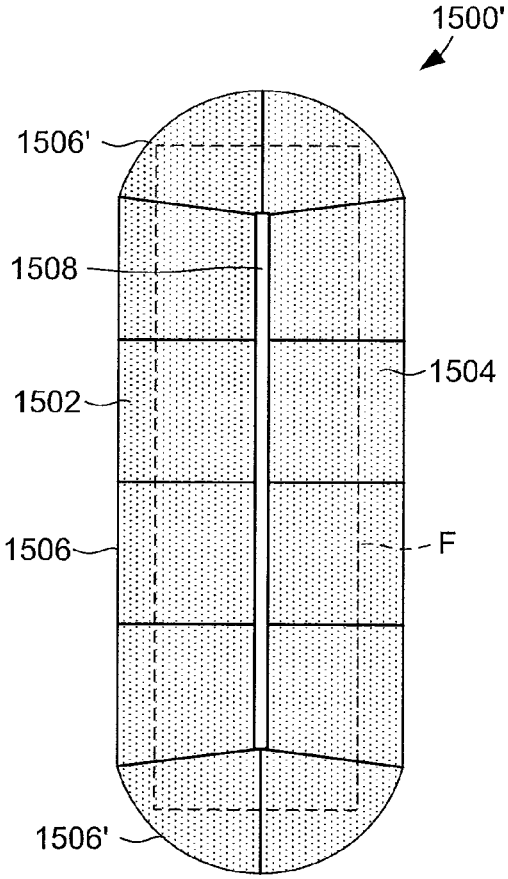

It will be noted that the hinge lines 1506 of the receptacle 1500 of FIG. 15A are generally linear in shape, so that the receptacle generally has a non-curvilinear shape. However, in this and in other embodiments, one or more of the hinge lines may have a curvilinear (e.g., curved or arcuate) shape, so that the receptacle or receiving element may be round, obround, oval, or may have any other curvilinear or at least partially curvilinear shape. For example, in one variation schematically illustrated in FIG. 15B, lines of disruption (e.g., hinge lines) 1506' disposed along opposite lengthwise ends of the receiving element or receptacle 1500' have a generally curved or arcuate shape, so that the receiving element or receptacle 1500' has a generally elongate (i.e., oval or obround) shape (in top plan view). In such an embodiment, it will be appreciated that in some instances, the segments 1502 associated with (i.e., adjacent to and connected by) such curved lines of disruptions (e.g., hinge lines) may tend to resist deforming to a greater extent than segments joined by a linear hinge line. As a result, the segments attached by the curved hinge lines may provide better contact between the food item and the susceptor film, and therefore, may provide improved browning and/or crisping of the food item. However, other possibilities are contemplated.

It will be noted that in these and other embodiments, each line of disruption (e.g., hinge lines 1506, 1506') may be inwardly arcuate (e.g., concave), outwardly arcuate (e.g., convex), linear, or any combination thereof. Countless possibilities are contemplated. It will also be appreciated that in these and other embodiments, the receiving element (e.g., receiving elements 1500, 1500') (and any associated blank and/or carton) may be sized (i.e., dimensioned) appropriately to receive a particular food item. Likewise, the carton or package may include a suitable number of receiving elements for a particular package. The carton may also include features (e.g., a cover that comprises a similar construct or structure including receptacles or receiving elements) for heating the top of the food item, for example, as described above in connection with FIG. 4. In this manner, the top of the elongated (or differently shaped) food item can also be heated, browned, and/or crisped in the manner described above.

The various blanks, trays, packages, systems, and other constructs described herein or contemplated hereby may be formed from various materials. In one aspect, any of the various blanks, trays, packages, systems, and other constructs may be formed from a paperboard material. The paperboard generally may have a basis weight of from about 60 to about 330 lbs/ream, for example, from about 80 to about 140 lbs/ream. The paperboard generally may have a thickness of from about 6 to about 30 mils, for example, from about 12 to about 28 mils. In one particular example, the paperboard has a thickness of about 12 mils. Any suitable paperboard may be used, for example, a solid bleached or solid unbleached sulfate board, such as SUS® board, commercially available from Graphic Packaging International. If needed or desired, one or more portions of the substrate may be laminated to or coated with one or more different or similar sheet-like materials at selected panels or panel sections.

If desired, one or more panels of the various blanks, trays, packages, systems, and other constructs described herein or contemplated hereby may be coated with varnish, clay, or other materials, either alone or in combination. The coating may then be printed over with product advertising or other information or images. The blanks, trays, packages, systems, and other constructs also may be coated to protect any information printed thereon. Furthermore, the blanks, trays, packages, systems, and other constructs may be coated with, for example, a moisture barrier layer, on either or both sides.

Alternatively or additionally, any of the blanks, trays, packages, systems, and other constructs of the present invention may be coated or laminated with other materials to impart other properties, such as absorbency, repellency, opacity, color, printability, stiffness, or cushioning. Alternatively or additionally, any of the blanks, trays, packages, systems, and other constructs of the present invention may be coated or laminated with other materials to impart other properties, such as absorbency, repellency, opacity, color, printability, stiffness, or cushioning. For example, absorbent susceptors are described in U.S. Provisional impart other properties, such as absorbency, repellency, opacity, color, printability, stiffness, or cushioning. For example, absorbent susceptors are described in U.S. Provisional Application No. 60/604,637, filed Aug. 25, 2004, and U.S. Patent Application Publication No. US 2006/0049190 A1, published Mar. 9, 2006, both of which are incorporated herein by reference in their entirety. Additionally, the constructs may include graphics or indicia printed thereon.

In the examples shown herein, the construct is somewhat square in shape. However, it will be understood that in this and other aspects of the invention described herein or contemplated hereby, numerous suitable shapes and configurations may be used to form the various panels and, therefore, constructs. Examples of other shapes encompassed hereby include, but are not limited to, polygons, circles, ovals, cylinders, prisms, spheres, polyhedrons, and ellipsoids. The shape of each construct may be determined largely by the type, shape, and quantity of the food item or items to be heated, browned, and/or crisped, and it should be understood that different packages are contemplated for different food items, for example, pretzel bites, potato balls, pizza bites, cheese sticks or balls, pastries, doughs, egg rolls, spring rolls, and so forth. Likewise, the construct may include gussets, pleats, additional panels, or any other feature needed or desired to accommodate a particular food item and/or portion size. Additionally, it will be understood that the present invention contemplates blanks and constructs for single-serving portions and for multiple-serving portions.

It also will be understood that in each of the various blanks and constructs described herein and contemplated hereby, a "fold line" can be any substantially linear, although not necessarily straight, form of weakening that facilitates folding therealong. More specifically, but not for the purpose of narrowing the scope of the present invention, a fold line may be a score line, such as lines formed with a blunt scoring knife, or the like, which creates a crushed portion in the material along the desired line of weakness, a cut that extends partially into a material along the desired line of weakness, and/or a series of cuts that extend partially into and/or completely through the material along the desired line of weakness, or any combination of these features. Where cutting is used to create a fold line, the cutting typically will not be overly extensive in a manner that might cause a reasonable user to consider incorrectly the fold line to be a tear line.

For example, one type of conventional tear line is in the form of a series of cuts that extend completely through the material, with adjacent cuts being spaced apart slightly so that a nick (e.g., a small somewhat bridging-like piece of the material) is defined between the adjacent cuts for typically temporarily connecting the material across the tear line. The nicks are broken during tearing along the tear line. Such a tear line that includes nicks can also be referred to as a cut line, since the nicks typically are a relatively small percentage of the subject line, and alternatively the nicks can be omitted from such a cut line. As stated above, where cutting is used to provide a fold line, the cutting typically will not be overly extensive in a manner that might cause a reasonable user to consider incorrectly the fold line to be a tear line. Likewise, where nicks are present in a cut line (e.g., tear line), typically the nicks will not be overly large or overly numerous in a manner that might cause a reasonable user to consider incorrectly the subject line to be a fold line.

Various exemplary blanks and constructs are shown and described herein as having fold lines, tear lines, score lines, and other lines as extending from a particular feature to another particular feature, for example from one particular panel to another, from one particular edge to another, or any combination thereof. However, it will be understood that such lines need not necessarily extend between such features in a precise manner. Instead, such lines may generally extend between the various features as needed to achieve the objective of such line. For instance, where a particular tear line is shown as extending from a first edge of a blank to another edge of the blank, the tear line need not extend completely to one or both of such edges. Rather, the tear line need only extend to a location sufficiently proximate to the edge so that the removable strip or panel can be manually separated from the blank or construct without causing undesirable damage thereto.

Although certain embodiments of this invention have been described with a certain degree of particularity, those skilled in the art could make numerous alterations to the disclosed embodiments without departing from the spirit or scope of this invention. All directional references (e.g., upper, lower, upward, downward, left, right, leftward, rightward, top, bottom, above, below, vertical, horizontal, clockwise, and counterclockwise) are used only for identification purposes to aid the reader's understanding of the various embodiments of the present invention, and do not create limitations, particularly as to the position, orientation, or use of the invention unless specifically set forth in the claims. Joinder references (e.g., joined, attached, coupled, connected, and the like) are to be construed broadly and may include intermediate members between a connection of elements and relative movement between elements. As such, joinder references do not necessarily imply that two elements are connected directly and in fixed relation to each other.

It will be recognized by those skilled in the art, that various elements discussed with reference to the various embodiments may be interchanged to create entirely new embodiments coming within the scope of the present invention. It is intended that all matter contained in the above description or shown in the accompanying drawings shall be interpreted as illustrative only and not limiting. Changes in detail or structure may be made without departing from the spirit of the invention. The detailed description set forth herein is not intended nor is to be construed to limit the present invention or otherwise to exclude any such other embodiments, adaptations, variations, modifications, and equivalent arrangements of the present invention.

Accordingly, it will be readily understood by those persons skilled in the art that, in view of the above detailed description of the invention, the present invention is susceptible of broad utility and application. Many adaptations of the present invention other than those herein described, as well as many variations, modifications, and equivalent arrangements will be apparent from or reasonably suggested by the present invention and the above detailed description thereof, without departing from the substance or scope of the present invention.

While the present invention is described herein in detail in relation to specific aspects, it is to be understood that this detailed description is only illustrative and exemplary of the present invention and is made merely for purposes of providing a full and enabling disclosure of the present invention. The detailed description set forth herein is not intended nor is to be construed to limit the present invention or otherwise to exclude any such other embodiments, adaptations, variations, modifications, and equivalent arrangements of the present invention.

What is claimed is:

1. A microwave energy interactive construct for heating a food item having a surface intended to be browned and/or crisped, comprising:

a dimensionally stable base;

a flanged receiving element, the flanged receiving element being shaped to receive the food item with the food item seated thereon, the flanged receiving element including a plurality of hingeable flange segments defined by a plurality of lines of disruption in the base; and microwave energy interactive material disposed on the hingeable flange segments, wherein the hingeable flange segments are operative for flexing downwardly to bring the microwave energy interactive material into close proximity with the surface of the food item seated thereon.

2. The construct of claim 1, wherein the flanged receiving element is substantially obround in shape.

3. The construct of claim 1, wherein the flanged receiving element is substantially elongate in shape.

4. The construct of claim 1, wherein the flanged receiving element is substantially circular in shape.

5. The construct of claim 1, wherein the flanged receiving element includes a substantially centrally located aperture, and the lines of disruption extend outwardly from the aperture.

6. The construct of claim 1, wherein the flange segments are each defined by a pair of adjacent lines of disruption terminating at respective end points, and a fold line extends between the respective end points.

7. The construct of claim 1, wherein the flange segments are operative for hinging along a fold line disposed between adjacent lines of disruption in response to an urging force applied to the flange segments.

8. The construct of claim 1, wherein the microwave energy interactive material comprises a susceptor operative for browning and/or crisping of the surface of the food item.

9. The construct of claim 1, wherein in a first configuration prior to receiving the food item in the flanged receiving element, the flange segments are substantially coplanar with the base, and in a second configuration after receiving the food item in the flanged receiving element, the flange segments are obliquely oriented with respect to the base.

10. The construct of claim 1, in combination with another construct of claim 1, wherein the constructs are pivotably connected to one another for pivoting the constructs between an open position and a closed position.

11. The combination of claim 10, wherein in the closed position, the constructs are in an opposed relationship with the respective bases facing one another, such that the respective flanged receiving elements are in substantial alignment with one another.

12. The construct of claim 1, in combination with a carton, the carton including a top panel, a bottom panel, and a plurality of walls defining an interior space, wherein the construct is adapted to be received within the interior space of the carton with an upper side of the base of the construct facing the top panel of the carton.

13. The combination of claim 12, further comprising a susceptor joined to the top panel of the carton.

14. The combination of claim 12, further comprising a microwave energy interactive insulating material joined to the top panel of the carton.

15. The combination of claim 14, wherein the microwave energy interactive insulating material includes a susceptor film, a moisture-containing layer joined to the susceptor film, and a polymer film layer joined to the moisture-containing layer in a predetermined pattern, thereby forming a plurality of closed cells between the moisture-containing layer and the polymer film layer, wherein the closed cells are operative for inflating in response to microwave energy.

16. The construct of claim 1, in combination with the food item, wherein the elongate food item is seated within the flanged receiving element so that the microwave energy interactive material disposed on the hingeable flange segments is in close proximity with the surface of the food item.

17. A microwave energy interactive construct, comprising:

a base;

a support element for defining a void beneath the base; and a receptacle for receiving a food item with the food item seated thereon, the receptacle including a plurality of hingeable tabs defined by a plurality of lines of disruption in the base, the hingeable tabs including microwave energy interactive material for converting at least a portion of microwave energy into thermal energy, wherein the hingeable tabs are operative for flexing downwardly into the void beneath the base to bring the microwave energy interactive material into close proximity with a surface of the food item seated thereon.

18. The construct of claim 17, in combination with the food item, wherein the food item and the receptacle each have a substantially circular shape.

19. The construct of claim 17, in combination with the food item, wherein the food item and the receptacle each have an elongated shape.

20. A microwave energy interactive construct, comprising:

a base;

a support element for elevating the base; and an elongate receptacle for receiving an elongate food item with the elongate food item seated thereon, the receptacle including a plurality of hingeable portions defined by cuts in the base, and an opening substantially centered within the receptacle, wherein the hingeable portions include microwave energy interactive material for converting at least a portion of microwave energy into thermal energy, the hingeable portions being operative for flexing downwardly to bring the microwave energy interactive material into close proximity with a surface of the elongate food item seated thereon.

21. The construct of claim 1, wherein the flanged receiving element is curvilinear in shape.

22. The construct of claim 1, wherein the flanged receiving element is non-curvilinear in shape.

23. The construct of claim 1, wherein the flanged receiving element is substantially polygonal in shape.

24. The construct of claim 1, wherein the flanged receiving element is substantially octagonal in shape.

25. The construct of claim 5, wherein the substantially centrally located aperture is defined by the flange segments while the flange segments are substantially coplanar with the base.

* * * * *